US008360762B2

(12) United States Patent
Nunami et al.

(10) Patent No.: US 8,360,762 B2
(45) Date of Patent: Jan. 29, 2013

(54) OIL PUMP ROTOR

(75) Inventors: Koji Nunami, Obu (JP); Hisashi Ono, Okazaki (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 620 days.

(21) Appl. No.: 12/529,810

(22) PCT Filed: Dec. 5, 2007

(86) PCT No.: PCT/JP2007/073489

§ 371 (c)(1),
(2), (4) Date: Sep. 3, 2009

(87) PCT Pub. No.: WO2008/111270

PCT Pub. Date: Sep. 18, 2008

(65) Prior Publication Data

US 2010/0129253 A1 May 27, 2010

(30) Foreign Application Priority Data

Mar. 9, 2007 (JP) ..... 2007-060288

(51) Int. Cl.
*F03C 4/00* (2006.01)
*F04C 2/00* (2006.01)

(52) U.S. Cl. ..... 418/150; 418/171

(58) Field of Classification Search ..... 418/150, 418/166, 171

See application file for complete search history.

(56) References Cited

U.S. PATENT DOCUMENTS 5,114,325 A 5/1992 Morita
5,368,455 A 11/1994 Eisenmann
5,813,844 A * 9/1998 Hosono et al. ..... 418/150
6,244,843 B1 6/2001 Kosuge (Continued)

FOREIGN PATENT DOCUMENTS

EP 1380754 A2 1/2004
EP 1 655 490 A1 5/2006

(Continued)

OTHER PUBLICATIONS

International Search Report (PCT/ISA/210) dated Dec. 27, 2007.

(Continued)

*Primary Examiner* — Theresa Trieu
(74) *Attorney, Agent, or Firm* — Buchanan Ingersoll & Rooney PC

(57) ABSTRACT

An oil pump rotor includes an inner rotor formed with n (n: a natural number) external teeth, and an outer rotor formed with n+1 internal teeth which are in meshing engagement with each of the external teeth. And the oil pump rotor is used in an oil pump that includes a casing having a suction port for drawing in fluid and a discharge port for discharging fluid and conveys the fluid by drawing in and discharging the fluid due to changes in volumes of cells formed between surfaces of the internal teeth and surfaces of the external teeth during rotations of the rotors under meshing engagement therebetween. And the tooth profile of the external teeth of the inner rotor is formed by a deformation in the circumferential direction and a deformation in the radial direction applied to a profile defined by a mathematical curve with the deformation in the circumferential direction is applied while maintaining the distance between the radius ($R_{A1}$) of an addendum circle ($A_1$) and the radius ($R_{A2}$) of the tooth groove circle ($A_2$).

7 Claims, 12 Drawing Sheets

U.S. PATENT DOCUMENTS

| | | | | |
|---|---|---|---|---|
| 7,052,258 | B2 | 5/2006 | Amano et al. | |
| 7,118,359 | B2 * | 10/2006 | Hosono | 418/150 |
| 7,427,192 | B2 * | 9/2008 | Lamparski et al. | 418/171 |
| 8,096,795 | B2 | 1/2012 | Ono et al. | |
| 2003/0165392 | A1 | 9/2003 | Hosono | |
| 2004/0009085 | A1 | 1/2004 | Lamparski et al. | |
| 2004/0022660 | A1 | 2/2004 | Eisenmann et al. | |
| 2004/0067151 | A1 | 4/2004 | Hosono | |
| 2004/0191101 | A1 | 9/2004 | Ogata et al. | |
| 2006/0171834 | A1 | 8/2006 | Ogata et al. | |
| 2007/0065327 | A1 | 3/2007 | Hosono | |
| 2009/0116989 | A1 | 5/2009 | Ono et al. | |

FOREIGN PATENT DOCUMENTS

| | | | |
|---|---|---|---|
| JP | 61-8484 | A | 1/1986 |
| JP | 63-126568 | U | 8/1988 |
| JP | 1-32083 | B2 | 6/1989 |
| JP | 9-256963 | A | 9/1997 |
| JP | 2003-56473 | | 2/2003 |
| JP | 2003-254409 | A | 9/2003 |
| JP | 2003-322088 | | 11/2003 |
| JP | 2004-36588 | A | 2/2004 |
| JP | 2004-353656 | A | 12/2004 |
| JP | 2005-36735 | A | 2/2005 |
| JP | 2005-69001 | A | 3/2005 |
| JP | 2005-76563 | A | 3/2005 |
| JP | 2005-90493 | A | 4/2005 |
| JP | 2006-009616 | | 1/2006 |
| WO | WO 2007/034888 | A1 | 3/2007 |

OTHER PUBLICATIONS

Written Opinion (PCT/ISA/237) dated Jan. 15, 2008.

JPO Office Action dated Mar. 29, 2012 in corresponding Japanese Patent Application No. 2009-503892 and English Translation thereof.

EPO Office Action dated May 29, 2012 in corresponding European Patent Application No. 07859717.6.

* cited by examiner (a)

(b)

(a)

(b)

OIL PUMP ROTOR

TECHNICAL FIELD

The present invention relates to an oil-pump rotor which draws in and discharges fluid through changes in the volumes of cells formed between an inner rotor and an outer rotor.

BACKGROUND ART

A conventional oil pump has an inner rotor formed with n external teeth where n is a natural number, an outer rotor formed with n+1 internal teeth that mesh with the external teeth, and a casing with an suction port which draws in fluid and a discharge port which discharges fluid. The outer rotor is rotated by rotating the inner rotor with the external teeth meshed with the internal teeth, which causes the volumes of a plurality of cells formed between the rotors to change to draw in or discharge the fluid.

The cells are individually separated by the virtue of the fact that external teeth of the inner rotor and internal teeth of the outer rotor contact at forward and rearward positions with respect to the rotating direction respectively, and of the fact that the both side surfaces are sealed by the casing, thereby forming individual fluid conveying chambers. And after the volume attains its minimum in the process of the engagement between the external teeth and the internal teeth, the volume of each cell increases to draw in fluid as it moves along the suction port, and after the volume attains its maximum, the volume decreases to discharge fluid as it moves along the discharge port.

Because of their small size and simple structure, the oil pumps having the above configuration are broadly used as pumps for lubricating oil, or for automatic transmissions, etc. in cars. When incorporated in a car, a crankshaft direct connect actuation is used as an actuating means for the oil pump, in which the inner rotor is directly linked with the engine crankshaft, and is driven by the rotation of the engine.

Incidentally, various types of oil pumps have been disclosed including the type which uses an inner rotor and an outer rotor in which the tooth profile is defined by a cycloid, (for example, see Patent Document 1), the type which uses an inner rotor in which the tooth profile is defined by an envelope for circular arcs that are centered on a trochoid (for example, see Patent Document 2), or the type which uses an inner rotor and an outer rotor in which the tooth profile is defined by two circular arcs in contact with each other, (for example, see Patent Document 3), and also an oil pump which uses an inner rotor and an outer rotor in which the tooth profile of each type described above is modified.

In recent years, the discharge capacity of the oil pump is on an increase due to a trend to make the driven valve system adjustable and due to an addition of the oil jet for piston cooling with increasing engine power. On the other hand, the miniaturization and reduction in the radius of the body of the oil pump are desired to reduce engine friction from the viewpoint of reducing the fuel cost. While it is common to reduce the number of teeth to increase the discharge amount of the oil pump, since the discharge amount per cell increases in an oil pump with a small number of teeth, the pulsation becomes more pronounced and there was the problem of noise due to vibration of pump housing etc.

While it is common to increase the number of teeth as a way to reduce pulsation and to suppress noise, if the number of teeth is increased with teeth having the tooth profile defined by a theoretical cycloid etc., the amount of discharge will decrease. And, in order to secure the required amount of discharge, either the outside radius of the rotor or the thickness needs to be increased, which results in problems such as increased size and weight or friction.

Patent Document 1: Japanese Patent Application Publication No. 2005-076563

Patent Document 2: Japanese Patent Application Publication No. H09-256963

Patent Document 3: Japanese Patent Application Publication No. S61-008484

DISCLOSURE OF THE INVENTION

The present invention was made to address the problems described above and its object is to provide an oil pump rotor in which the discharge rate is increased while reducing pulsation and noise level without increasing the rotor size.

To solve the problems mentioned above, an oil pump rotor comprises an inner rotor formed with n (n: a natural number) external teeth, and an outer rotor formed with n+1 internal teeth which are in meshing engagement with each of the external teeth. And the oil pump rotor is used with an oil pump that includes a casing having an suction port for drawing in fluid and a discharge port for discharging fluid, and conveys the fluid by drawing in and discharging the fluid due to changes in volumes of cells formed between surfaces of the internal teeth and surfaces of the external teeth during rotations of the rotors under meshing engagement therebetween. And the tooth profile of the external teeth of the inner rotor of the present invention is formed by a deformation in the circumferential direction and a deformation in the radial direction applied to a profile defined by a mathematical curve, with the deformation in the circumferential direction applied while maintaining the distance between the radius $R_{A1}$ of an addendum circle $A_1$ and the radius $R_{A2}$ of the tooth groove circle $A_2$.

This makes it possible to increase the discharge rate without increasing the rotor size, and to provide an oil pump rotor with reduced pulsation and noise level.

A mathematical curve in this context refers to a curve expressed by a mathematical function, examples of which include an envelope of circular arcs centered on a cycloid or a trochoid, and a circular-arc-shaped curve in which the addendum portion and the tooth groove portion are defined by two circular arcs that are in contact with each other.

And, as one of a preferred embodiment of the inner rotor, there is an inner rotor whose tooth profile is one in which the deformation in the circumferential direction is applied with a first deformation ratio $\gamma_1$ when the portion outwardly of the circle $C_1$ of radius $R_{C1}$ which satisfies $R_{A1}>R_{C1}>R_{A2}$ is deformed, and is applied with a second deformation ratio $\gamma_2$ when the portion inwardly of the circle $C_1$ is deformed, and in which the shape of the addendum is defined by a curve defined by Equations (1) to (4) when the portion outwardly of the circle $D_1$ of radius $R_{D1}$ which satisfies $R_{A1}>R_{D1}\geqq R_{C1}\geqq R_{D2}>R_{A2}$ is deformed, and the shape of the tooth groove is defined by a curve defined by Equations (5) to (8) when the portion inwardly of the circle $D_2$ of radius $R_{D2}$ is deformed wherein $$R_{12}=(X_{11}^2+Y_{11}^2)^{1/2}, \quad (1)$$

$$\theta_{12}=\arccos(X_{11}/R_{12}), \quad (2)$$

$$X_{12}=\{(R_{12}-R_{D1})\times\beta_{10}+R_{D1}\}\times\cos\theta_{12}, \quad (3)$$

$$Y_{12}=\{(R_{12}-R_{D1})\times\beta_{10}+R_{D1}\}\times\sin\theta_{12}, \quad (4)$$

where, $(X_{11}, Y_{11})$ are the coordinates of the shape of the addendum before the deformation in the radial direction, $(X_{12}, Y_{12})$ are the coordinates of the shape of the addendum after the deformation in the radial direction, $R_{12}$ is the distance from the center of the inner rotor to the coordinates $(X_{11}, Y_{11})$, $\theta_{12}$ is the angle which the straight line which passes through the center of the inner rotor and the coordinates $(X_{11}, Y_{11})$ makes with the X-axis, and $\beta_{10}$ is the correction coefficient for the deformation, and $$R_{22}=(X_{21}^2+Y_{21}^2)^{1/2}, \quad (5)$$

$$\theta_{22}=\arccos(X_{21}/R_{22}), \quad (6)$$

$$X_{22}=\{R_{D2}-(R_{D2}-R_{22})\times\beta_{20}\}\times\cos\theta_{22}, \quad (7)$$

$$Y_{22}=\{R_{D2}-(R_{D2}-R_{22})\times\beta_{20}\}\times\sin\theta_{22}, \quad (8)$$

where, $(X_{21}, Y_{21})$ are the coordinates of the shape of the tooth groove before the deformation in the radial direction, $(X_{22}, Y_{22})$ are the coordinates of the shape of the tooth groove after the deformation in the radial direction, $R_{22}$ is the distance from the center of the inner rotor to coordinates $(X_{21}, Y_{21})$, $\theta_{22}$ is the angle which the straight line which passes through the center of the inner rotor and the coordinates $(X_{21}, Y_{21})$ makes with the X-axis, and $\beta_{20}$ is the correction coefficient for the deformation.

In addition, as another preferred embodiment of the inner rotor, there is an inner rotor in which the addendum portion, which is outwardly of a reference circle $C_\alpha$ that goes through an addendum side meshing point a of the inner rotor with the outer rotor, is deformed with a deformation ratio $\epsilon$ that satisfies $0<\epsilon<1$.

This allows further reduction in the pulsation in oil discharged from the oil pump by making uniform the clearance between the addendum of the inner rotor and the outer rotor.

Specifically, as one of preferred embodiments of an inner rotor and the outer rotor that meshes with the inner rotor where the inner rotor is formed by deforming a tooth profile defined by a cycloid in the circumferential direction and in the radial direction by taking a cycloid as the mathematical curve, there is one in which a profile of the external teeth of the inner rotor is formed by a deformation, in the circumferential direction and a deformation in the radial direction with a base circle of a cycloid being the circle $C_1$, applied to a tooth profile defined by the cycloid with the base circle radius $R_a$, the exterior rolling circle radius $R_{a1}$, and the interior rolling circle radius $R_{a2}$, and a profile of the internal teeth of the outer rotor that meshes with the inner rotor is formed by a deformation in the circumferential direction and a deformation in the radial direction applied to a tooth profile defined by a cycloid with the base circle radius $R_b$, the exterior rolling circle radius $R_{b1}$, and the internal rolling circle radius $R_{b2}$, with the deformation in the circumferential direction performed while maintaining the distance between the radius $R_{B1}$ of an tooth groove circle $B_1$ and the radius $R_{B2}$ of an addendum circle $B_2$, wherein the deformation of the outer rotor in the circumferential direction is applied with a third deformation ratio $\delta_3$ when a portion outwardly of the base circle of radius $R_b$ is deformed, and is applied with a fourth deformation ratio $\delta_4$ when a portion inwardly of the base circle of radius $R_b$ is deformed, and, in the deformation of the outer rotor in the radial direction, the shape of a tooth groove is defined by a curve defined by Equations (9) to (12) when the portion outwardly of the circle $D_3$ of radius $R_{D3}$ which satisfies $R_{B1}>R_{D3}\geqq R_b\geqq R_{D4}>R_{B2}$ is deformed, and the shape of an addendum is defined by a curve defined by Equations (13) to (16) when the portion inwardly of a circle $D_4$ of radius $R_{D4}$ is deformed.

In addition, the outer rotor satisfies the relationships, that are expressed by Equations (17) to (21), with the inner rotor wherein $$R_{32}=(X_{31}^2+Y_{31}^2)^{1/2}, \quad (9)$$

$$\theta_{32}=\arccos(X_{31}/R_{32}), \quad (10)$$

$$X_{32}=\{(R_{32}-R_{D3})\times\beta_{30}+R_{D3}\}\times\cos\theta_{32}, \quad (11)$$

$$Y_{32}=\{(R_{32}-R_{D3})\times\beta_{30}+R_{D3}\}\times\sin\theta_{32}, \quad (12)$$

where $(X_{31}, Y_{31})$ are the coordinates of the shape of the tooth groove before the deformation in the radial direction, $(X_{32}\square Y_{32})$ are the coordinates of the shape of the tooth groove after the deformation in the radial direction, $R_{32}$ is the distance from the center of the outer rotor to the coordinates $(X_{31}\square Y_{31})$, $\theta_{32}$ is the angle which a straight line which passes through the center of the outer rotor and the coordinates $(X_{31}\square Y_{31})$ makes with the X-axis, and $\beta_{30}$ is a correction coefficient for the deformation, wherein $$R_{42}=(X_{41}^2+Y_{41}^2)^{1/2}, \quad (13)$$

$$\theta_{42}=\arccos(X_{41}/R_{42}), \quad (14)$$

$$X_{42}=\{R_{D4}-(R_{D4}-R_{42})\times\beta_{40}\}\times\cos\theta_{42}, \quad (15)$$

$$Y42=\{R_{D4}-(R_{D4}-R_{42})\times\beta_{40}\}\times\sin\theta_{42}, \quad (16)$$

where, $(X_{41}, Y_{41})$ are the coordinates of the shape of an addendum before the deformation in the radial direction, $(X_{42}, Y_{42})$ are the coordinates of the shape of an addendum after the deformation in the radial direction, $R_{42}$ is the distance from the center of the outer rotor to the coordinates $(X_{41}, Y_{41})$, $\theta_{42}$ is the angle which the straight line which passes through the center of the outer rotor and the coordinates $(X_{41}, Y_{41})$ makes with the X-axis, and $\beta_{40}$ is a correction coefficient for the deformation, and, $$R_a=n\times(R_{a1}\times\gamma_1+R_{a2}\times\gamma_2), \quad (17)$$

$$R_b=(n+1)\times(Rb1\times\delta3+Rb2\times\delta4), \quad (18)$$

$$R_b=R_a+R_{a1}+R_{a2}+H1, \quad (19)$$

$$R_{b2}=R_{a2}+H2, \quad (20)$$

$$e_{10}=R_{a1}+R_{a2}+H3, \quad (21)$$

where $e_{10}$ is a distance or eccentricity between the center of the inner rotor and the center of the outer rotor, and H1, H2, and H3 are correction values for the outer rotor to rotate with clearance.

While the external tooth profile of the inner rotor is formed in each of the above-mentioned configurations by a deformation in the circumferential direction and a deformation in the radial direction applied to the tooth profile defined by a mathematical curve, the external tooth profile of the inner rotor may be formed by a compressing deformation in the circumferential direction, omitting a deformation in the radial direction.

More specifically, an oil pump rotor may be one that comprises an inner rotor formed with n (n: a natural number) external teeth, and an outer rotor formed with n+1 internal teeth. And the oil pump rotor is used with an oil pump that includes a casing having a suction port for drawing in fluid and a discharge port for discharging fluid, and conveys the fluid by drawing in and discharging the fluid due to changes in volumes of cells formed between surfaces of the internal teeth and surfaces of the external teeth during rotations of the rotors under meshing engagement therebetween. And the tooth profile of the external teeth of the inner rotor is formed by a compressing deformation in the circumferential direction applied to a profile defined by a mathematical curve while maintaining the distance between the radius $R_{A1}$ of an addendum circle $A_1$ and the radius $R_{A2}$ of the tooth groove circle $A_2$.

This makes it possible to increase the discharge rate while maintaining the rotor radius, and to provide an oil pump rotor with reduced pulsation and noise level.

In addition, as one of the preferred embodiments of an outer rotor that meshes with an inner rotor formed by applying a deformation in the circumferential direction and a deformation in the radial direction to a tooth profile defined by a mathematical curve, or by applying a compressing deformation in the circumferential direction to the profile, there is an outer rotor that meshes with the inner rotor and that has a tooth profile formed by:

with an envelope formed by making the inner rotor revolve along a circumference of a circle F centered on a position that is a set distance e away from the center of the inner rotor and having a radius equal to the set distance at an angular velocity $\omega$, while rotating the inner rotor about itself in a direction opposite to a direction of the revolution at an angular velocity $\omega/n$ which is 1/n times the angular velocity $\omega$ of the revolution with a revolution angle being defined such that an angle of the center of the inner rotor as seen from the center of the circle F is taken to be 0 revolution angle at a start of the revolution, deforming, in a radially outward direction, at least a neighborhood of an intersecting portion between the envelope and an axis in a direction of 0 revolution angle;

deforming, in a radially outward direction, a neighborhood of an intersecting portion between the envelope and an axis in a direction of the revolution angle $\pi/(n+1)$;

extracting, as a partial envelope, a portion contained in a region defined by revolution angles greater than or equal to 0 and less than or equal to $\pi/(n+1)$ in the envelope;

rotating the partial envelope in a direction of revolution with respect to the center of the circle by a minute angle $\alpha$;

cutting off a portion that falls out of the region;

connecting a gap formed between the partial envelope and the axis in the direction of 0 revolution angle to form a corrected partial envelope;

duplicating the corrected partial envelope to have a line symmetry with respect to the axis in the direction of 0 revolution angle to form a partial tooth profile; and duplicating the partial tooth profile at each rotation angle of $2\pi/(n+1)$ with respect to the center of the circle F.

This facilitates forming an outer rotor that meshes smoothly with an inner rotor that is formed by applying a deformation in the circumferential direction and a deformation in the radial direction to a tooth profile defined by the mathematical curve, or by applying a compressing deformation in the circumferential direction to the profile.

BEST MODES FOR CARRYING OUT THE INVENTION

Figure 1:
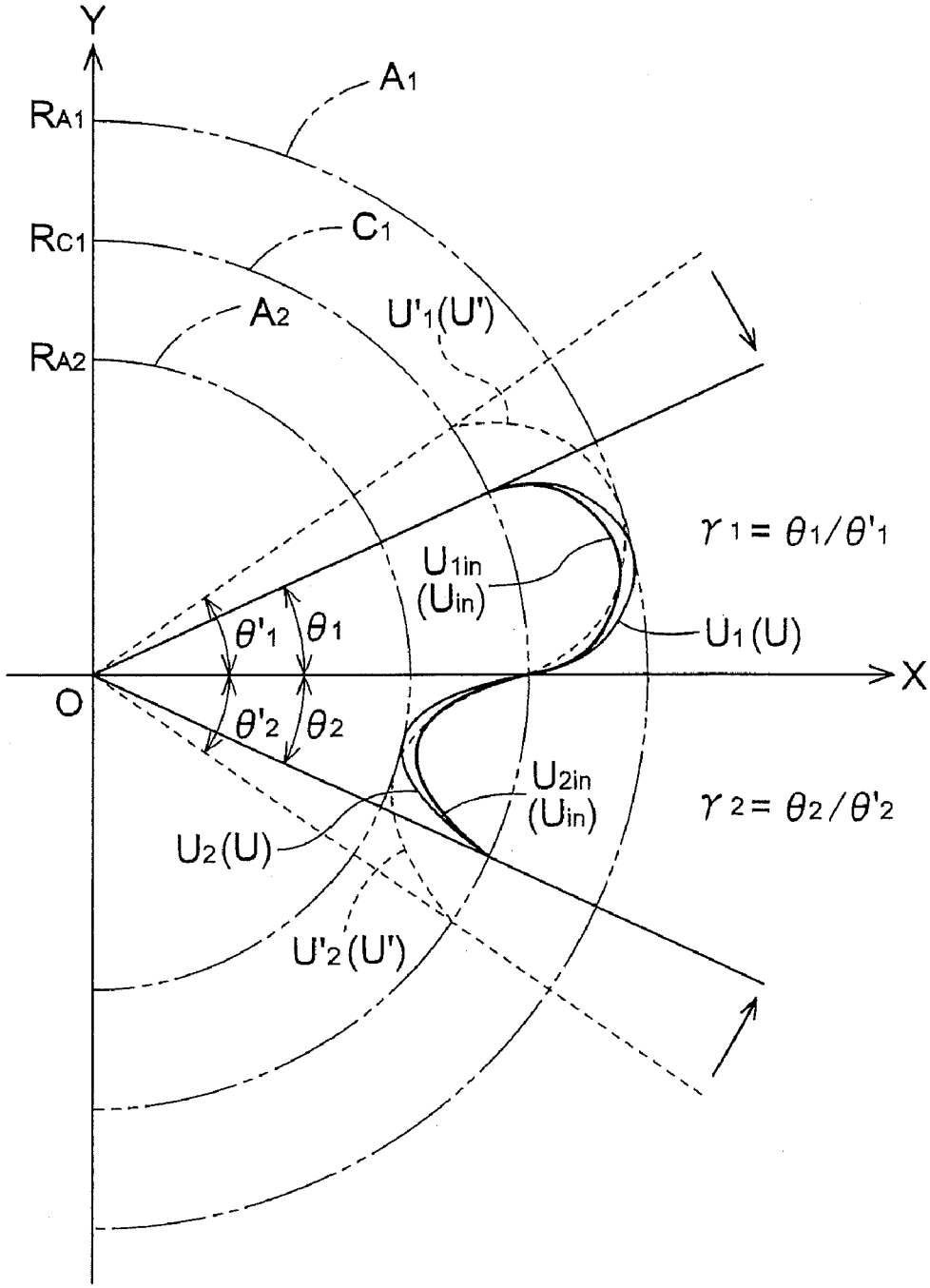
[FIG. 1] is a diagram showing a deformation of the inner rotor in the circumferential direction in accordance with the present invention.
Figure 2:
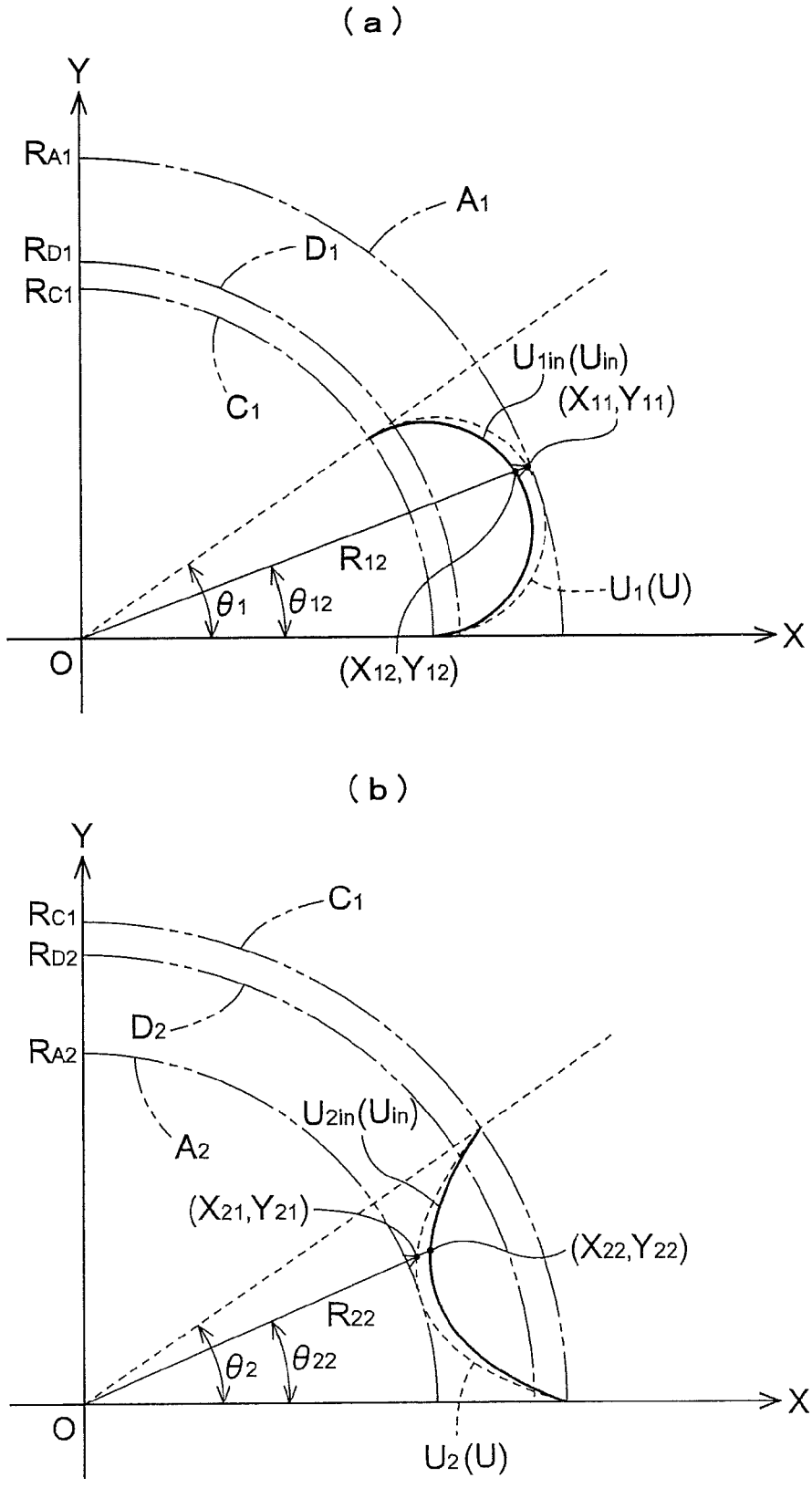
[FIG. 2] is a diagram showing a deformation of the inner rotor in the radial direction in accordance with the present invention.

FIGS. 1 and 2 are diagrams showing the principle of a process for forming the tooth profile (external tooth profile) of the inner rotor in accordance with the present invention by applying a deformation in the circumferential direction and a deformation in the radial direction to a mathematical curve. While the addendum portion and tooth groove portion of only one tooth among the external teeth formed in the inner rotor are shown in FIGS. 1 and 2 without showing other gear teeth, the same deformation is naturally applied to all the gear teeth.

FIG. 1 shows the deformation in the circumferential direction applied to the tooth profile defined by a mathematical curve. The shape of the addendum $U'_1$ and the shape of the tooth groove $U'_2$ of the tooth profile U' defined by the mathematical curve are shown in FIG. 1 by the dotted line, and the radius of the addendum circle $A_1$ in which the shape of the addendum $U'_1$ is inscribed is denoted by $R_{A1}$ and the radius of the tooth groove circle $A_2$ which the shape of the tooth groove $U'_2$ circumscribes is denoted by $R_{A2}$. And the shape of the addendum $U'_1$ is defined by the tooth profile U' that is located outwardly of radius $R_{C1}$ of the circle $C_1$ which satisfies $R_{A1}>R_{C1}>R_{A2}$, and the shape of the tooth groove $U'_2$ is defined by the tooth profile U' that is located inwardly of radius $R_{C1}$ of the circle $C_1$.

And the deformed tooth profile U can be obtained by making the deformation in the circumferential direction with a predetermined deformation ratio, maintaining the distance $(R_{A1}-R_{A2})$ between the radius $R_{A1}$ of the addendum circle $A_1$, and the radius $R_{A2}$ of the tooth groove circle $A_2$. In FIG. 1, when the portion outwardly of the circle $C_1$ of radius $R_{C1}$, i.e., the shape of the addendum $U'_1$, is deformed, it is deformed with the first deformation ratio $\gamma_1$, and when the portion inwardly of the circle $C_1$ of radius $R_{C1}$, i.e., the shape of the tooth groove $U'_2$, is deformed, it is deformed with the second deformation ratio $\gamma_2$. Here, this deformation ratio is the ratio of an angle before the deformation and the angle after the deformation with the angle formed by a half line which connects the center O of the inner rotor and one end of the curve that defines the shape of the addendum (or the shape of the tooth groove), and by a half line which connects the center O of the inner rotor and the other end of the curve. In FIG. 1, the angle for the shape of the addendum $U_1$ is $\theta'_1$ before the deformation, and is $\theta_1$ after the deformation. And thus, the shape of the addendum $U_1$ is deformed by the first deformation ratio given by $\gamma_1=\theta_1/\theta'_1$. Similarly, the angle for the shape of the tooth groove $U_2$ is $\theta'_2$ before the deformation, and is $\theta_2$ after the deformation. And thus, the shape of the tooth groove $U_2$ is deformed by the second deformation ratio given by $\gamma_2=\theta_2/\theta'_2$. The deformed tooth profile U (the shape of the addendum $U_1$ and the shape of the tooth groove $U_2$) is obtained by this deformation in the circumferential direction.

The equation for the conversion to obtain the tooth profile U, which is obtained from the tooth profile U' by deforming it in the circumferential direction, can be simply expressed as follows by using the deformation ratio $\gamma_1$ or $\gamma_2$. Specifically, since the coordinates $(X_{10}, Y_{10})$ of the shape of the addendum $U'_1$ in FIG. 1 can be expressed as $(R \cos \theta_{11}, R \sin \theta_{11})$ when the distance between these coordinates and the center O of the inner rotor is R and the angle which the straight line passing through the center O of the inner rotor and the coordinates makes with the X-axis is $\theta_{11}$, the coordinates $(X_{11}, Y_{11})$ for the corresponding shape of the addendum $U_1$, which is obtained by deforming in the circumferential direction, can be expressed as $(R \cos(\theta_{11}\times\gamma_1), R \sin(\theta_{11}\times\gamma_1))=(R \cos \theta_{12}, R \sin \theta_{12})$ using the deformation ratio $\gamma_1$. Here, $\theta_{12}$ is the angle which the straight line that passes through the center O of the inner rotor and the coordinates $(X_{11}, Y_{11})$ makes with the X-axis. The shape of the tooth groove can be similarly expressed using the deformation ratio $\gamma_2$.

And, if the number of teeth (the number of the external teeth) of the inner rotor before and after the deformation in the circumferential direction is n' and n, respectively (n' and n are natural numbers), the equation $n'\times(\theta'_1+\theta'_2)=n\times(\theta_1+\theta_2)$ holds.

Thus, the deformation in the circumferential direction, that maintains the distance between the radius $R_{A1}$ of the addendum circle $A_1$ and the radius $R_{A2}$ of the tooth groove circle $A_2$, is a deformation performed to the tooth profile included in the fan-shaped region with its peak at the center O of the rotor, where the distance is maintained and where the deformation is made in correspondence to a change of the peak angle. And, when the deformation ratio $\gamma$, which is the ratio of the peak angle before and after the deformation, is such that $\gamma>1$, it is an enlarging deformation, and when $\gamma<1$, it is a compressing deformation.

FIG. 2 shows the deformation of the tooth profile U in the radial direction after deforming the tooth profile U' defined by the mathematical curve in the circumferential direction as described above An example of a deformation in the radial direction is described below. When the portion outwardly of the circle $D_1$ of radius $R_{D1}$ which satisfies $R_{A1}>R_{D1}\geqq R_{C1}\geqq R_{D2}>R_{A2}$ is deformed, the shape of the addendum is defined by a curve defined by Equations (1) to (4), and when the portion inwardly of the circle $D_2$ of radius $R_{D2}$ is deformed, the shape of the tooth groove is defined by a curve defined by Equations (5) to (8).

$$R_{12}=(X_{11}^2+Y_{11}^2)^{1/2} \tag{1}$$

$$\theta_{12}=\arccos(X_{11}/R_{12}) \tag{2}$$

$$X_{12}=\{(R_{12}-R_{D1})\times\beta_{10}+R_{D1}\}\times\cos \theta_{12} \tag{3}$$

$$Y_{12}=\{(R_{12}-R_{D1})\times\beta_{10}+R_{D1}\}\times\sin \theta_{12} \tag{4}$$

Here, $(X_{11}, Y_{11})$ are the coordinates of the shape of the addendum before the deformation in the radial direction, $(X_{12}, Y_{12})$ are the coordinates of the shape of the addendum after the deformation in the radial direction, $R_{12}$ is the distance from the center of the inner rotor to the coordinates $(X_{11}, Y_{11})$, $\theta_{12}$ is the angle which the straight line which passes through the center of the inner rotor and the coordinates $(X_{11}, Y_{11})$ makes with the X-axis, and $\beta_{10}$ is the correction coefficient for the deformation.

$$R_{22}=(X_{21}^2+Y_{21}^2)^{1/2} \tag{5}$$

$$\theta_{22}=\arccos(X_{21}/R_{22}) \tag{6}$$

$$X_{22}=\{R_{D2}-(R_{D2}-R_{22})\times\beta_{20}\}\times\cos \theta_{22} \tag{7}$$

$$Y_{22}=\{R_{D2}-(R_{D2}-R_{22})\times\beta_{20}\}\times\sin \theta_{22} \tag{8}$$

Here, $(X_{21}, Y_{21})$ are the coordinates of the shape of the tooth groove before the deformation in the radial direction, $(X_{22}, Y_{22})$ are the coordinates of the shape of the tooth groove after the deformation in the radial direction, $R_{22}$ is the distance from the center of the inner rotor to coordinates $(X_{21}, Y_{21})$, $\theta_{22}$ is the angle which the straight line which passes through the center of the inner rotor and the coordinates $(X_{21}, Y_{21})$ makes with the X-axis, and $\beta_{20}$ is the correction coefficient for deformation.

FIG. 2 (*a*) shows the deformation in the radial direction using the above-mentioned Equations (1) to (4), which is applied to the shape of the addendum $U_1$ (shown by the dotted line) that is formed by the deformation in the circumferential direction mentioned above. And the shape of the addendum $U_{1in}$ is obtained by this deformation in the radial direction. In addition, FIG. 2 (*b*) shows the deformation in the radial direction using the above-mentioned Equations (5) to (8), which is applied to the shape of the tooth groove $U_2$ (shown by the dotted line) that is formed by the deformation in the circumferential direction mentioned above. And the shape of the tooth groove $U_{2in}$ is obtained by this deformation in the radial direction. That is, in Equations above (1) to (8), the coordinates of the shape of the addendum $U_1$ and the shape of the tooth groove $U_2$ before the deformation in the radial direction are expressed by $(X_{11}, Y_{11})$, and $(X_{21}, Y_{21})$ respectively, and the coordinates of the shape of the addendum $U_{1in}$ and the shape of the tooth groove $U_{2in}$ after the deformation in the radial direction are expressed by $(X_{12}, Y_{12})$, and $(X_{22}, Y_{22})$ respectively. However, the portion between $R_{D1}$ and $R_{D2}$ is not deformed by this deformation in the radial direction.

Thus, the tooth profile $U_{in}$ (the shape of the addendum $U_{1in}$ and the shape of the tooth groove $U_{2in}$) of the inner rotor in accordance with the present invention can be obtained by applying the above-mentioned deformation in the circumferential direction, and the deformation in the radial direction to the tooth profile U' defined by a mathematical curve.

While not only values greater than 1 but values smaller than 1 may be used for the correction coefficients $\beta_{10}$ and $\beta_{20}$ for deformations especially in the radial direction as shown in FIG. 2, in such cases, the value is chosen such that at least either the shape of the addendum or the shape of the tooth groove is greater in the radial direction (in the radially outward direction for the shape of the addendum and radially inward direction for the shape of the tooth groove) to increase its discharge amount in comparison with an inner rotor which has the tooth profile defined by a mathematical curve and which has the same number of teeth n as the number of teeth of the inner rotor in the present invention, that is, an inner rotor which has n addenda and tooth grooves defined by the mathematical curve with respect to the circle $C_1$ of the radius $R_{C1}$.

And with respect to the changes in the circumferential direction, FIGS. 1 and 2 show the case where $n'<n$ when the number of teeth of the inner rotor before and after the deformation in the circumferential direction are n' and n respectively, that is, both the deformation ratios $\gamma_1$ and $\gamma_2$ are less than 1 to have a compressing deformation. However, these deformation ratios $\gamma_1$ and $\gamma_2$ may be greater than 1 to have an enlarging deformation (i.e., n'>n). As mentioned above, the values are chosen for the correction coefficients $\beta_{10}$ and $\beta_{20}$ for deformations in the radial direction again such that at least either the shape of the addendum or the shape of the tooth groove is greater in the radial direction (in the radially outward direction for the shape of the addendum and radially inward direction for the shape of the tooth groove) to increase its discharge amount in comparison with an inner rotor which has the tooth profile defined by the mathematical curve and which has the same number of teeth n as the number of teeth of the inner rotor in the present invention.

And, while a deformation in the radial direction is performed after performing a deformation in the circumferential direction in FIGS. 1 and 2, the order may be reversed to perform a deformation in the circumferential direction maintaining the distance between the radius of the addendum circle and the radius of the tooth groove circle, after performing a deformation in the radial direction. Furthermore, one may choose a configuration where the shape of the addendum and the shape of the tooth groove are deformed with the same deformation ratio without using $R_{c1}$ in FIG. 1. In addition, a deformation in the circumferential direction and deformation in the radial direction may similarly be applied to the outer rotor to form a tooth profile (internal tooth profile) which meshes properly with the inner rotor.

[Tooth Profile Defined by a Deformed Cycloid]

The tooth profiles of the inner rotor and the outer rotor when using a cycloid as the mathematical curve are described next with reference to FIG. 3 to FIG. 7.

Figure 3:
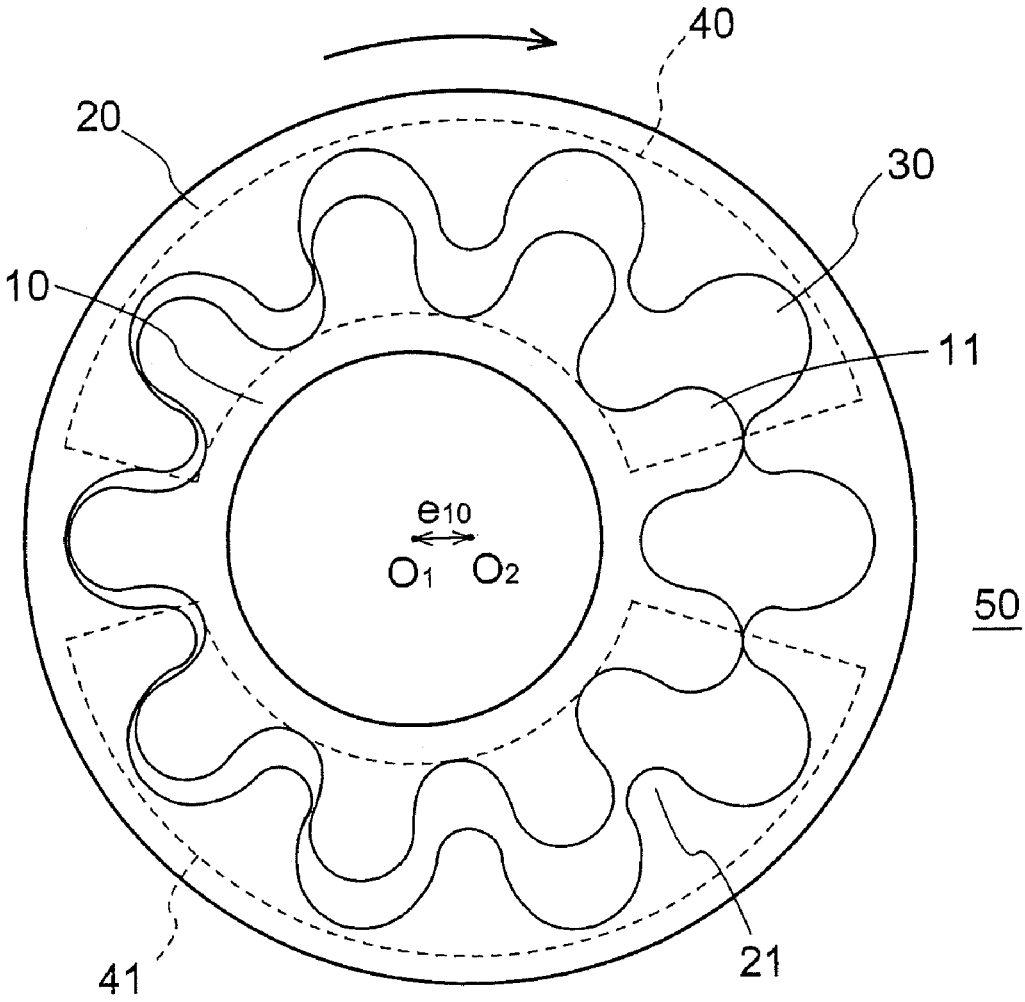
[FIG. 3] is a figure showing an oil pump whose tooth-profile is defined by a deformed cycloid.

The oil pump shown in FIG. 3 is an embodiment where a deformation in the circumferential direction, and a deformation in the radial direction are applied to a tooth profile defined by a cycloid. The oil pump includes an inner rotor 10 in which nine external teeth 11 are formed, an outer rotor 20 in which ten internal teeth 21 that mesh with the external teeth 11 of the inner rotor 10 are formed, and a casing 50 in which an suction port 40 which draws in fluid and a discharge port 41 which discharges fluid are formed. And the oil pump conveys fluid by drawing in and discharging the fluid through changes in the volumes of the cells 30 formed between the tooth surfaces of both rotors as the rotors mesh each other and rotate.

Figure 4:
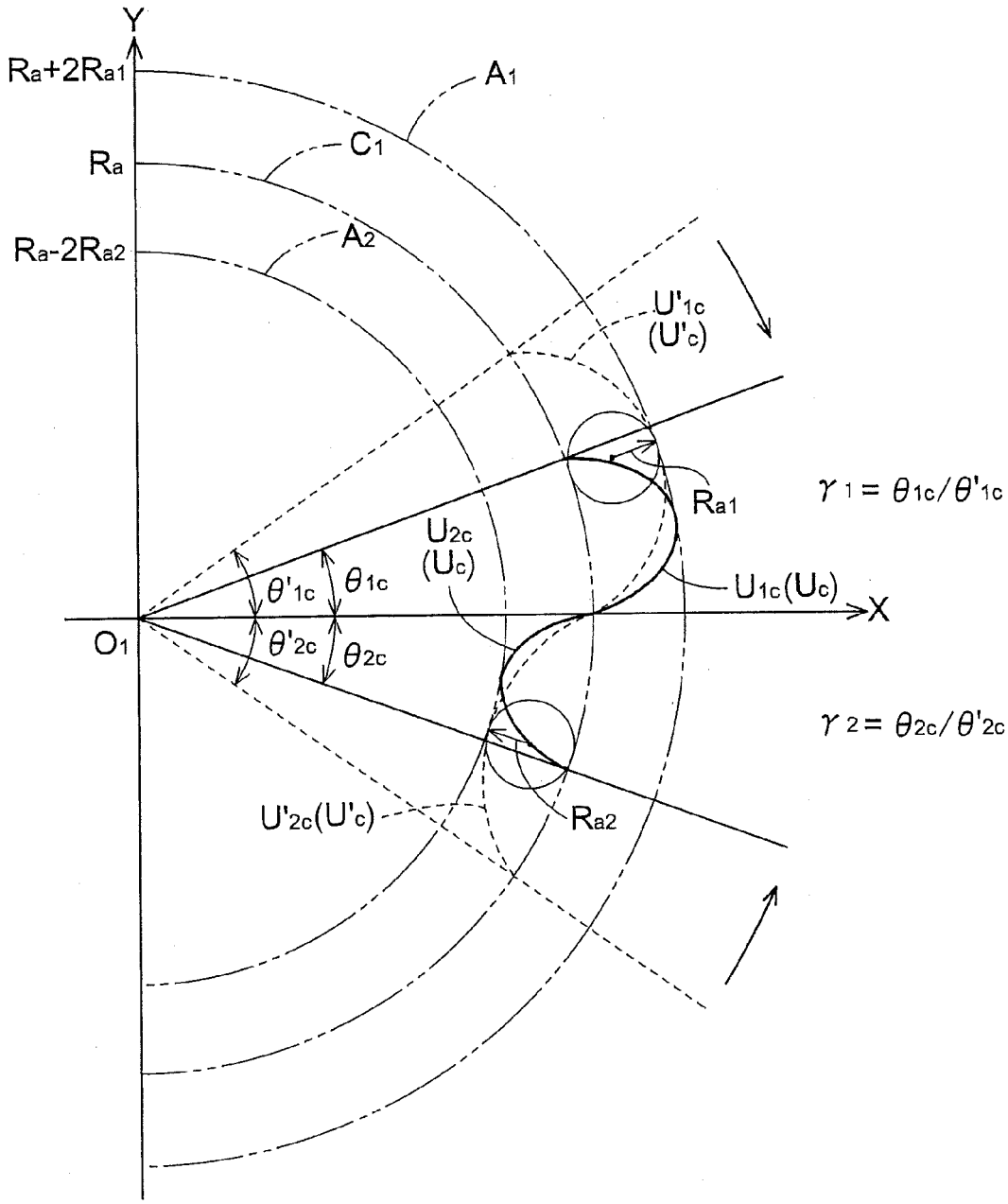
[FIG. 4] is a diagram to describe forming of the inner rotor shown in FIG. 3 (with deformation in the circumferential direction)
Figure 5:
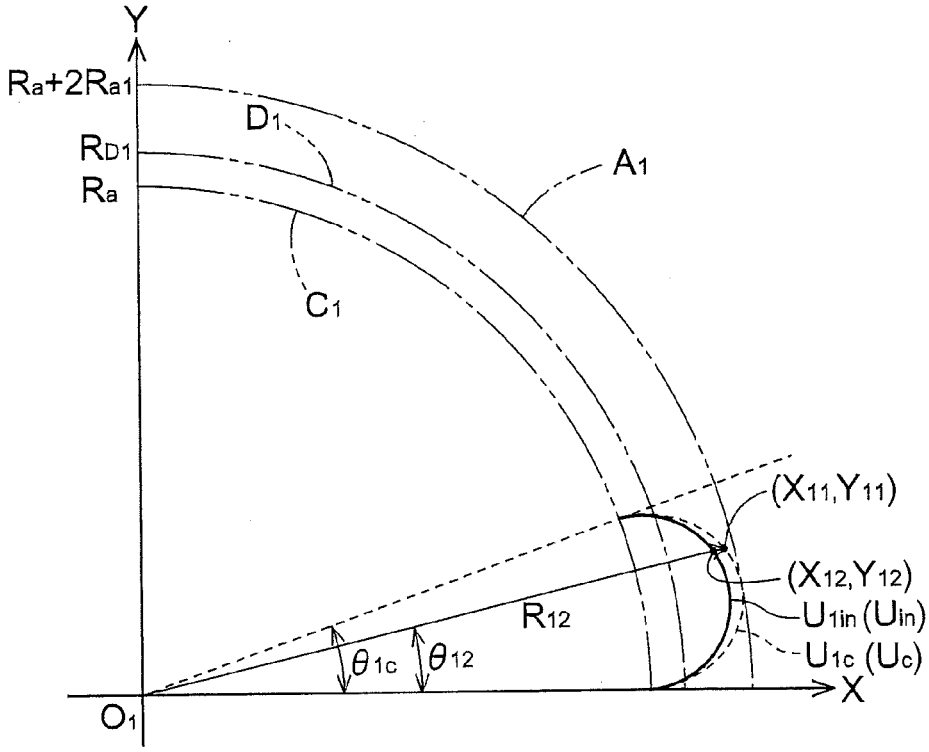
[FIG. 5] is a diagram to describe forming of the inner rotor shown in FIG. 3 (with deformation in the radial direction)
Figure 5:
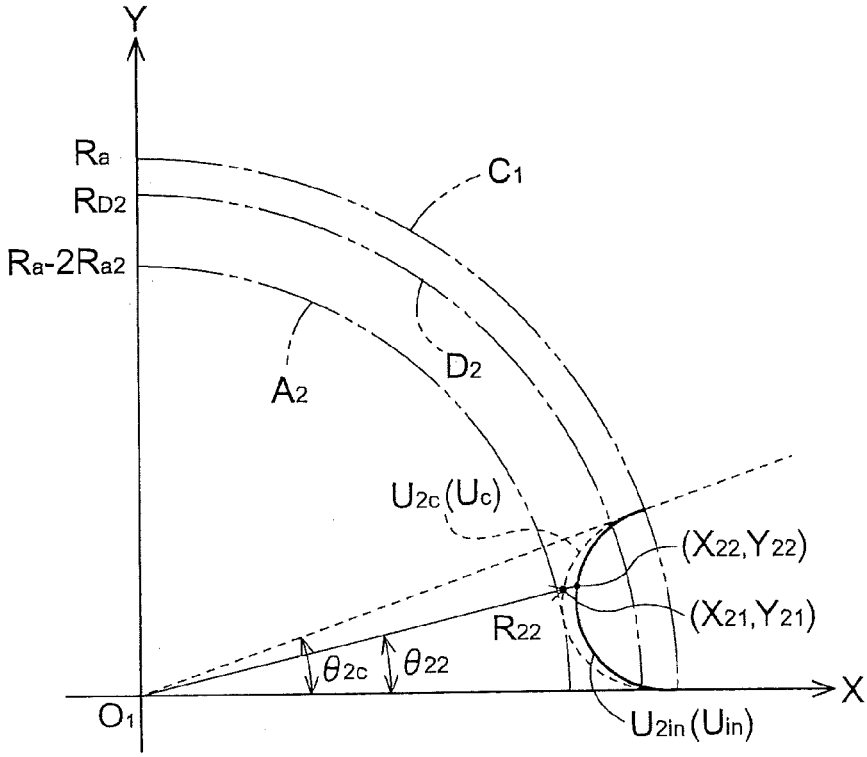

FIGS. 4 and 5 are diagrams to describe forming of the inner rotor 10 shown in FIG. 3. FIG. 4 between the two shows the tooth profile after a deformation in the circumferential direction is applied to the tooth profile defined by a cycloid and corresponds to FIG. 1 described above, and FIG. 5 shows the tooth profile after a deformation in the radial direction is applied to the tooth profile after the deformation in the circumferential direction is applied, and corresponds to FIG. 2 described above.

The shape of the addendum $U'_{1C}$ and the shape of the tooth groove $U'_{2C}$ of the tooth profile $U'_C$ defined by the cycloid curve are shown in FIG. 4 by the dotted lines. And, when the base circle radius of this cycloid is $R_a$, the radius of the exterior rolling circle is $R_{a1}$ and the radius of the interior rolling circle is $R_{a2}$, the radius of the addendum circle $A_1$ in which the shape of the addendum $U'_{1C}$ is inscribed can be expressed as $R_a+2R_{a1}$, and the radius of the tooth groove circle $A_2$ which the shape of the tooth groove $U'_{2C}$ circumscribes can be expressed as $R_a-2R_{a2}$. In addition, the radius $R_{C1}$ of the circle $C_1$ which defines the boundary between the addendum portion and the tooth groove portion in FIG. 1 is the radius $R_a$ of the base circle in this FIG. 4. That is, the shape of the addendum $U'_{1C}$ is defined by the cycloid formed by the exterior rolling circle of radius $R_{a1}$, and the shape of the tooth groove $U'_{2C}$ is defined by the cycloid formed by the interior rolling circle of radius $R_{a2}$.

In addition, the coordinates of the known cycloid with the base circle radius $R_a$, the exterior rolling circle radius $R_{a1}$, and the interior rolling circle radius $R_{a2}$ can be expressed by the following equations (figures are omitted).

$$X_{10}=(R_a+R_{a1})\times\cos\theta_{10}-R_{a1}\times\cos[\{(R_a+R_{a1})/R_{a1}\}\times\theta_{10}] \quad (31)$$

$$Y_{10}=(R_a+R_{a1})\times\sin\theta_{10}-R_{a1}\times\sin[\{(R_a+R_{a1})/R_{a1}\}\times\theta_{10}] \quad (32)$$

$$X_{20}=(R_a-R_{a2})\times\cos\theta_{20}+R_{a2}\times\cos[\{(R_{a2}-R_a)/R_{a2}\}\times\theta_{20}] \quad (33)$$

$$Y_{20}=(R_a-R_{a2})\times\sin\theta_{20}+R_{a2}\times\sin[\{(R_{a2}-R_a)/R_{a2}\}\times\theta_{20}] \quad (34)$$

$$R_a=n\times(R_{a1}+R_{a2}) \quad (35)$$

Here, the X-axis is a straight line passing through the center $O_1$ of the inner rotor 10, and the Y-axis is the straight line which intersects perpendicularly with the X-axis and passes through the center $O_1$ of the inner rotor 10. In Equations (31) to (35), $\theta_{10}$ is the angle which the straight line that passes through the center of the exterior rolling circle and the center $O_1$ of the inner rotor makes with the X-axis, $\theta_{20}$ is the angle which the straight line that passes through the center of the interior rolling circle and the center $O_1$ of the inner rotor makes with the X-axis, $(X_{10}, Y_{10})$ are the coordinates of the cycloid formed by the exterior rolling circle, and $(X_{20}, Y_{20})$ are the coordinates of the cycloid formed by the interior rolling circle.

And the deformed tooth profile $U_C$ can be obtained by applying the deformation in the circumferential direction with a predetermined deformation ratio, maintaining the distance between the radius $R_a+2R_{a1}$ of the addendum circle $A_1$ and the radius, $R_a-2R_{a2}$ of the tooth groove circle $A_2$. In FIG. 4, when the portion outwardly of the base circle radius $R_a$ i.e., the shape of the addendum $U'_{1C}$ is deformed, it is deformed with the first deformation ratio $\gamma_1=\theta_{1C}/\theta'_{1C}$, and when the portion inwardly of the base circle radius $R_a$ i.e., the shape of the tooth groove $U'_{2C}$ is deformed, it is deformed with the second deformation ratio $\gamma_2=\theta_{2C}/\theta'_{2C}$. The definitions of this angle $\theta_{1C}$, etc. are the same as ones given above. The deformed tooth profile $U_C$ (the shape of the addendum $U_{1C}$ and the shape of the tooth groove $U_{2C}$) is obtained by this deformation in the circumferential direction. And, if the number of teeth (the number of the external teeth) of the inner rotor before and after the deformation in the circumferential direction is n' and n, respectively, the equation $n'\times(\theta'_{1C}+\theta'_{2C})=n\times(\theta_{1C}+\theta_{2C})$ holds.

The equation for the conversion to obtain the tooth profile $U_C$ from the tooth profile $U'_C$ can be simply expressed as follows by using the deformation ratio $\gamma_1$ or $\gamma_2$. For example, as for the shape of the addendum, the shape of the addendum $U'_{1C}$ before the deformation in the circumferential direction is the cycloid $(X_{10}, Y_{10})$ described above, and the coordinates $(X_{11}, Y_{11})$ of the shape of the addendum $U_{1C}$ after the deformation in the circumferential direction can be expressed by the following Equations (36) to (39).

$$R_{11}=(X_{10}^2+Y_{10}^2)^{1/2} \quad (36)$$

$$\theta_{11}=\arccos(X_{10}/R_{11}) \quad (37)$$

$$X_{11}=R_{11}\times\cos(\theta_{11}\times\gamma_1) \quad (38)$$

$$Y_{11}=R_{11}\times\sin(\theta_{11}\times\gamma_1) \quad (39)$$

Here, $R_{11}$ is the distance from the center $O_1$ of the inner rotor to coordinates $(X_{10}, Y_{10})$, and $\theta_{11}$ is the angle which the straight line which passes through the center $O_1$ of the inner rotor and the coordinates $(X_{10}, Y_{10})$ makes with the X-axis.

The coordinates $(X_{21}, Y_{21})$ of the shape of the tooth groove $U_{2C}$ after the deformation in the circumferential direction can be easily and similarly obtained by using the deformation ratio $\gamma_2$ from the above-mentioned cycloid $(X_{20}, Y_{20})$ which is the shape of the tooth groove $U'_{2C}$ before the deformation in the circumferential direction. Accordingly, the derivation is omitted here.

Next, the deformation in the radial direction as shown in FIG. 5 is applied to the tooth profile $U_C$ which was deformed in the circumferential direction. Firstly, for the portion outwardly (addendum side) of the circle $D_1$ of radius $R_{D1}$ which satisfies $R_a+2R_{a1}>R_{D1}\geqq R_a\geqq R_{D2}>R_a-2R_{a2}$, the shape of the addendum after the deformation is defined by the curve given by the coordinates $(X_{12}, Y_{12})$ expressed by the following Equations (1) to (4) as shown in FIG. 5 (*a*).

$$R_{12}=(X_{11}^2+Y_{11}^2)^{1/2} \tag{1}$$

$$\theta_{12}=\arccos(X_{11}/R_{12}) \tag{2}$$

$$X_{12}=\{(R_{12}-R_{D1})\times\beta_{10}+R_{D1}\}\times\cos\theta_{12} \tag{3}$$

$$Y_{12}=\{(R_{12}-R_{D1})\times\beta_{10}+R_{D1}\}\times\sin\theta_{12} \tag{4}$$

Here, $(X_{11}, Y_{11})$ are the coordinates of the shape of the addendum $U_{1C}$ before the deformation in the radial direction, $(X_{12}, Y_{12})$ are the coordinates of the shape of the addendum $U_{1in}$ after the deformation in the radial direction, $R_{12}$ is the distance from the center $O_1$ of the inner rotor to the coordinates $(X_{11}, Y_{11})$, $\theta_{12}$ is the angle which the straight line which passes through the center $O_1$ of the inner rotor and the coordinates $(X_{11}, Y_{11})$ makes with the X-axis, and $\beta_{10}$ is the correction coefficient for the deformation.

And, for the portion inwardly (tooth groove side) of the circle $D_2$ of radius $R_{D2}$ which satisfies $R_a+2R_{a1}>R_{D1}\geqq R_a\geqq R_{D2}>R_a-2R_{a2}$, the shape of the tooth groove after the deformation is defined by the curve given by the coordinates $(X_{22}, Y_{22})$ expressed by the following Equations (5) to (8) as shown in FIG. 5 (*b*).

$$R_{22}=(X_{21}^2+Y_{21}^2)^{1/2} \tag{5}$$

$$\theta_{22}=\arccos(X_{21}/R_{22}) \tag{6}$$

$$X_{22}=\{R_{D2}-(R_{D2}-R_{22})\times\beta_{20}\}\times\cos\theta_{22} \tag{7}$$

$$Y_{22}=\{R_{D2}-(R_{D2}-R_{22})\times\beta_{20}\}\times\sin\theta_{22} \tag{8}$$

Here $(X_{21}, Y_{21})$ are the coordinates of the shape of the tooth groove $U_{2C}$ before the deformation in the radial direction, $(X_{22}, Y_{22})$ are the coordinates of shape of the tooth groove $U_{2in}$, after the deformation in the radial direction, $R_{22}$ is the distance from the center $O_1$ of the inner rotor to the coordinates $(X_{21}, Y_{21})$, $\theta_{22}$ is the angle which the straight line which passes through the center $O_1$ of the inner rotor and the coordinates $(X_{21}, Y_{21})$ makes with the X-axis, and $\beta_{20}$ is the correction coefficient for the deformation.

That is, the shape of the addendum $U_{1in}$ is obtained from the shape of the addendum $U_{1C}$ by the deformation in the radial direction shown in FIG. 5 (*a*), and the shape of the tooth groove $U_{2in}$ is obtained from the shape of the tooth groove $U_{2C}$ by the deformation in the radial direction shown in FIG. 5 (*b*). Thus, by applying the above-mentioned deformation in the circumferential direction and the deformation in the radial direction to the tooth profile U' defined by a cycloid, the tooth profile $U_{in}$ (the shape of the addendum $U_{1in}$ and the shape of the tooth groove $U_{2in}$) of the inner rotor defined by the deformed cycloid can be obtained, whereby the external tooth profile of the inner rotor 10 shown in FIG. 3 can be formed.

Figure 6:
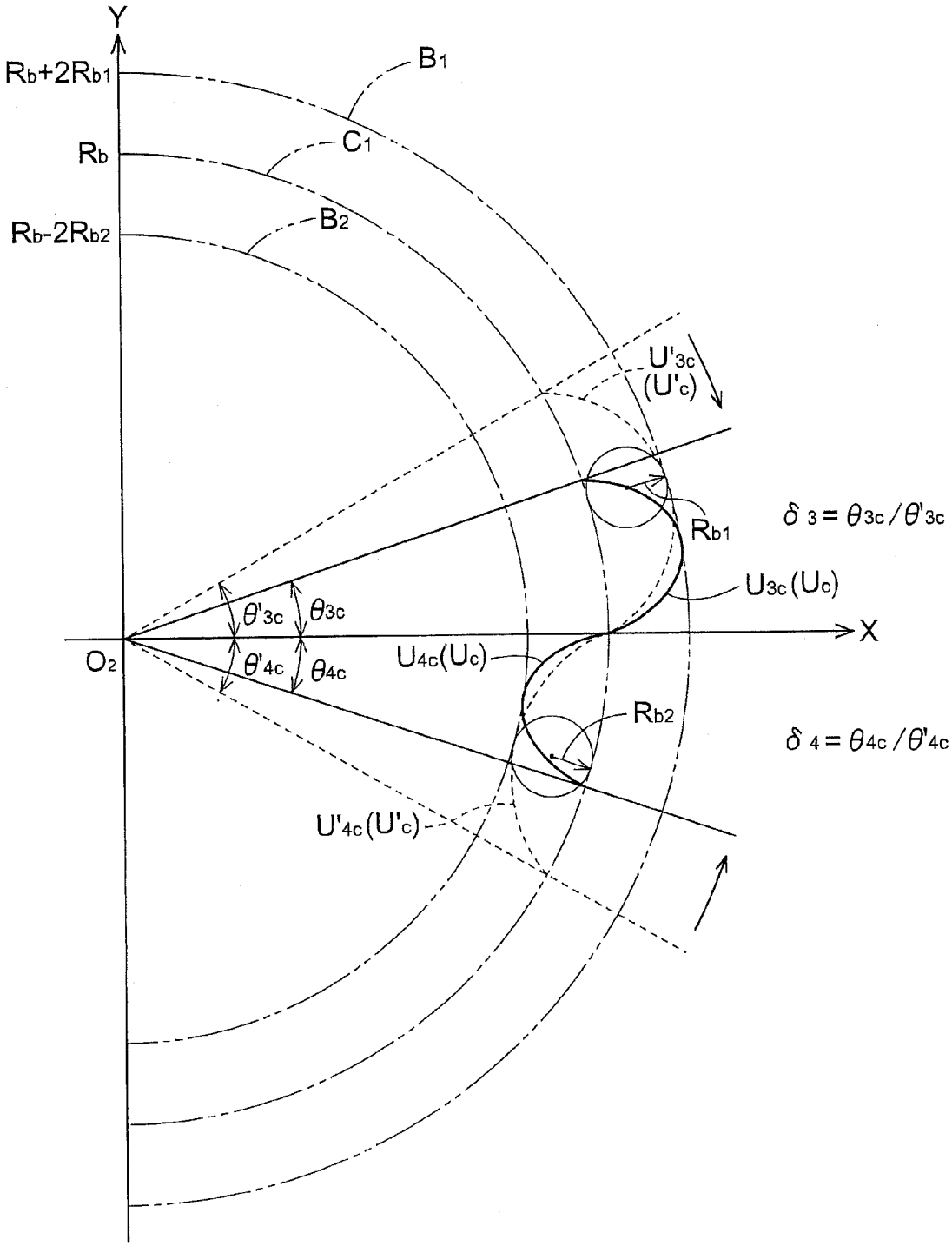
[FIG. 6] is a diagram to describe forming of the outer rotor shown in FIG. 3 (with deformation in the circumferential direction)
Figure 7:
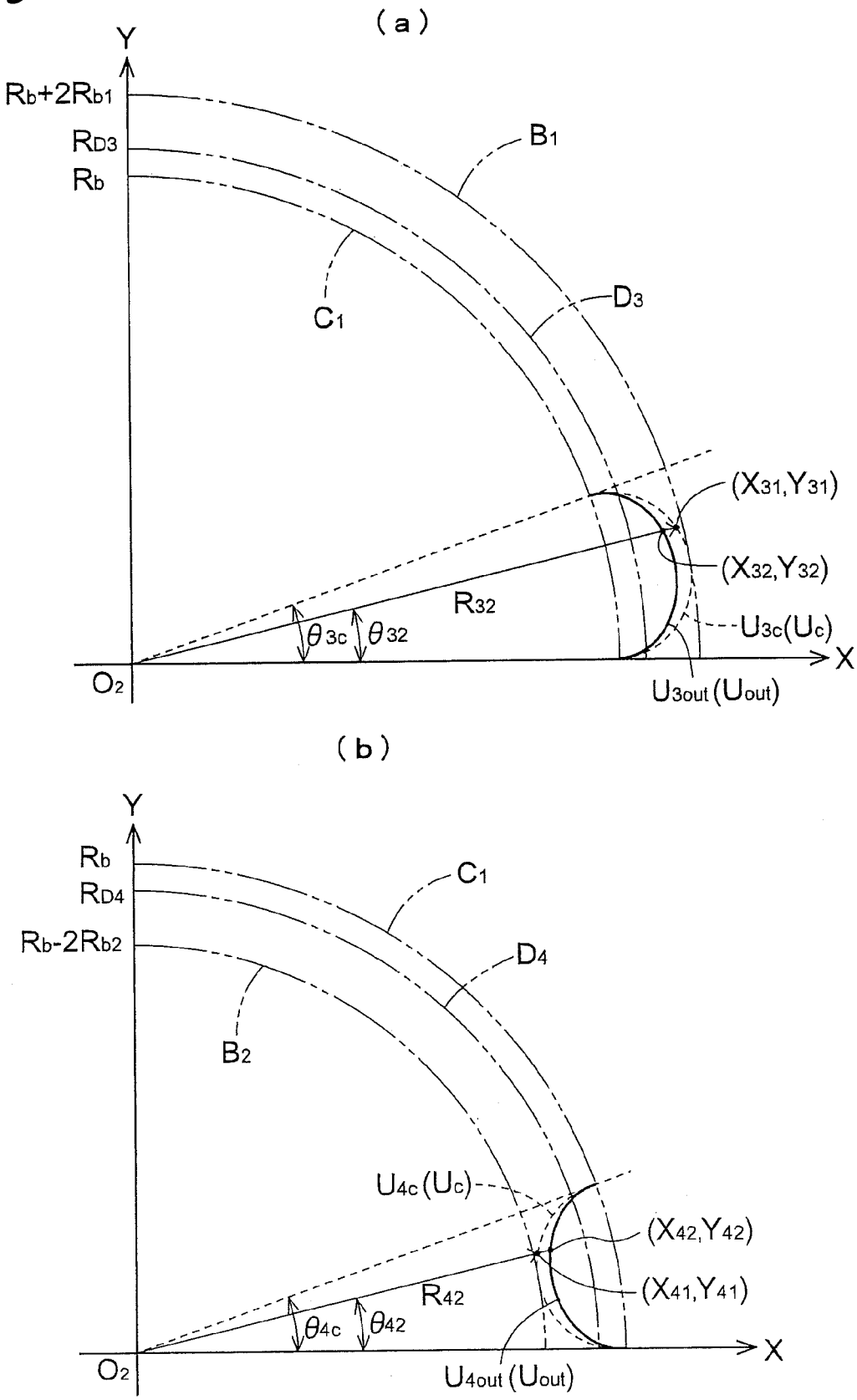
[FIG. 7] is a diagram to describe forming of the outer rotor shown in FIG. 3 (with deformation in the radial direction)

On the other hand, FIGS. 6 and 7 are diagrams to describe forming of the outer rotor 20 shown in FIG. 3. FIG. 6 between the two shows the tooth profile after a deformation in the circumferential direction is applied to the tooth profile defined by a cycloid and corresponds to FIG. 1 described above as applied to an outer rotor, and FIG. 7 shows the tooth profile after a deformation in the radial direction is applied to the tooth profile after the deformation in the circumferential direction is applied, and corresponds to FIG. 2 described above as applied to an outer rotor.

The shape of the tooth groove $U'_{3C}$ and the shape of the addendum $U'_{4C}$ of the tooth profile $U'_C$ defined by the cycloid are shown in FIG. 6 by the dotted lines. And, when the base circle radius of this cycloid is $R_b$, the radius of the exterior rolling circle is $R_{b1}$ and the radius of the interior rolling circle is $R_{b2}$, the radius of the tooth groove circle $B_1$ in which the shape of the tooth groove $U'_{3C}$ is inscribed can be expressed as $R_b+2R_{b1}$, and the radius of the tooth addendum circle $B_2$ which the shape of the addendum $U'_{4C}$ circumscribes can be expressed as $R_b-2R_{b2}$. In addition, the radius $R_{C1}$ of the circle $C_1$ which defines the boundary between the addendum portion and the tooth groove portion in FIG. 1 is the radius $R_b$ of the base circle in this FIG. 6. That is, the shape of the tooth groove $U'_{3C}$ is defined by the cycloid formed by the exterior rolling circle of radius $R_{b1}$, and the shape of the addendum $U'_{4C}$ is defined by the cycloid formed by the interior rolling circle of radius $R_{b2}$.

In addition, the coordinates of the known cycloid with the base circle radius $R_b$, the exterior rolling circle radius $R_{b1}$, and the interior rolling circle radius $R_{b2}$ can be expressed by the following equations (figures are omitted).

$$X_{30}=(R_b+R_{b1})\cos\theta_{30}-R_{b1}\times\cos[\{(R_b+R_{b1})/R_{b1}\}\times\theta_{30}] \tag{41}$$

$$Y_{30}=(R_b+R_{b1})\sin\theta_{30}-R_{b1}\times\sin[\{(R_b+R_{b1})/R_{b1}\}\times\theta_{30}] \tag{42}$$

$$X_{40}=(R_b-R_{b2})\cos\theta_{40}+R_{b2}\times\cos[\{(R_{b2}-R_b)/R_{b2}\}\times\theta_{40}] \tag{43}$$

$$Y_{40}=(R_b-R_{b2})\sin\theta_{40}+R_{b2}\times\sin[\{(R_{b2}-R_b)/R_{b2}\}\times\theta_{40}] \tag{44}$$

$$R_b=(n+1)\times(R_{b1}+R_{b2}) \tag{45}$$

Here, the X-axis is a straight line passing through the center $O_2$ of the outer rotor 20, and the Y-axis is the straight line which intersects perpendicularly with the X-axis and passes through the center $O_2$ of the outer rotor 20. In Equations (41) to (45), $\theta_{30}$ is the angle which the straight line that passes through the center of the exterior rolling circle and the center $O_2$ of the outer rotor 20 makes with the X-axis, $\theta_{40}$ is the angle which the straight line that passes through the center of the interior rolling circle and the center $O_2$ of the outer rotor 20 makes with the X-axis, $(X_{30}, Y_{30})$ are the coordinates of the cycloid formed by the exterior rolling circle, and $(X_{40}, Y_{40})$ are the coordinates of the cycloid formed by the interior rolling circle.

And the deformed tooth profile $U_C$ can be obtained by applying the deformation in the circumferential direction with the predetermined deformation ratio, maintaining the distance between the radius $R_b+2R_{b1}$ of the tooth groove circle $B_1$ and the radius $R_b-2R_{b2}$ of the addendum circle $B_2$. In FIG. 6, when the portion outwardly of the base circle radius $R_b$, i.e., the shape of the tooth groove $U'_{3C}$, is deformed, it is deformed with the third deformation ratio $\delta_3=\theta_{3C}/\theta'_{3C}$, and when the portion inwardly of the base circle radius $R_b$, i.e., the shape of the addendum $U'_{4C}$, is deformed, it is deformed with the fourth deformation ratio $\delta_4=\theta_{4C}/\theta'_{4C}$. In addition, the definitions of this angle $\theta_{3C}$ etc. are the same as those in the case of the inner rotor. The deformed tooth profile $U_C$ (the shape of the tooth groove $U_{3C}$ and the shape of the addendum $U_{4C}$) is obtained by this deformation in the circumferential direction. And, if the number of teeth (the number of the external teeth) of the outer rotor before and after the deformation in the circumferential direction is (n'+1) and (n+1), respectively, the equation $(n'+1)\times(\theta'_{3C}+\theta'_{4C})=(n+1)\times(\theta_{3C}+\theta_{4C})$ holds.

The equation for the conversion to obtain the tooth profile $U_C$ from the tooth profile $U'_C$ can be simply expressed as follows by using the deformation ratio $\delta_3$ or $\delta_4$. For example, as for the shape of the tooth groove, the shape of the tooth groove $U'_{3C}$ before the deformation in the circumferential direction is the cycloid $(X_{30}, Y_{30})$ described above, and the coordinates $(X_{31}, Y_{31})$ of the shape of the tooth groove $U_{3C}$ after the deformation in the circumferential direction can be expressed by the following Equations (46) to (49).

$$R_{31}=(X_{30}^2+Y_{30}^2)^{1/2} \quad (46)$$

$$\theta_{31}=\arccos(X_{30}/R_{31}) \quad (47)$$

$$X_{31}=R_{31}\times\cos(\theta_{31}\times\delta_3) \quad (48)$$

$$Y_{31}=R_{31}\times\sin(\theta_{31}\times\delta_3) \quad (49)$$

Here, $R_{31}$ is the distance from the center $O_2$ of the outer rotor to coordinates $(X_{30}, Y_{30})$, and $\theta_{31}$ is the angle which the straight line which passes through the center $O_2$ of the outer rotor and the coordinates $(X_{30}, Y_{30})$ makes with the X-axis.

The coordinates $(X_{41}, Y_{41})$ of the shape of the addendum $U_{4C}$ after the deformation in the circumferential direction can be easily and similarly obtained by using the deformation ratio $\delta_4$ from the above-mentioned cycloid $(X_{40}, Y_{40})$ which is the shape of the addendum $U'_{4C}$ before the deformation in the circumferential direction. Accordingly, the derivation is omitted here.

Next, the deformation in the radial direction as shown in FIG. 7 is applied to the tooth profile $U_C$ which was deformed in the circumferential direction. Firstly, for the portion outwardly (tooth groove side) of the circle $D_3$ of radius $R_{D3}$ which satisfies $R_b+2R_{b1}>R_{D3}\geqq R_b\geqq R_{D4}>R_b-2R_{b2}$, the shape of the tooth groove after the deformation is defined by the curve given by the coordinates $(X_{32}, Y_{32})$ expressed by the following Equations (9) to (12) as shown in FIG. 7 (*a*).

$$R_{32}=(X_{31}^2+Y_{31}^2)^{1/2} \quad (9)$$

$$\theta_{32}=\arccos(X_{31}/R_{32}) \quad (10)$$

$$X_{32}=\{(R_{32}-R_{D3})\times\beta_{30}+R_{D3}\}\times\cos\theta_{32} \quad (11)$$

$$Y_{32}=\{(R_{32}-R_{D3})\times\beta_{30}+R_{D3}\}\times\sin\theta_{32} \quad (12)$$

Here, $(X_{31}, Y_{31})$ are the coordinates of the shape of the tooth groove $U_{3C}$ before the deformation in the radial direction, $(X_{32}, Y_{32})$ are the coordinates of the shape of the tooth groove $U_{3out}$ after the deformation in the radial direction, $R_{32}$ is the distance from the center $O_2$ of the outer rotor to the coordinates $(X_{31}, Y_{31})$, $\theta_{32}$ is the angle which the straight line which passes through the center $O_2$ of the outer rotor and the coordinates $(X_{31}, Y_{31})$ makes with the X-axis, and $\beta_{30}$ is the correction coefficient for the deformation.

And, for the portion inwardly (tooth groove side) of the circle $D_4$ of radius $R_{D4}$ which satisfies $R_b+2R_{b1}>R_{D3}\geqq R_b\geqq R_{D4}>R_b-2R_{b2}$, the shape of the addendum after the deformation is defined by the curve given by the coordinates $(X_{42}, Y_{42})$ expressed by the following Equations (13) to (16) as shown in FIG. 7 (*b*).

$$R_{42}=(X_{41}^2+Y_{41}^2)^{1/2} \quad (13)$$

$$\theta_{42}=\arccos(X_{41}/R_{42}) \quad (14)$$

$$X_{42}=\{R_{D4}-(R_{D4}-R_{42})\times\beta_{40}\}\times\cos\theta_{42} \quad (15)$$

$$Y_{42}=\{R_{D4}-(R_{D4}-R_{42})\times\beta_{40}\}\times\sin\theta_{42} \quad (16)$$

Here, $(X_{41}, Y_{41})$ are the coordinates of the shape of the addendum $U_{4C}$ before the deformation in the radial direction, $(X_{42}, Y_{42})$ are the coordinates of the shape of the addendum $U_{4out}$ after the deformation in the radial direction, $R_{42}$ is the distance from the center $O_2$ of the outer rotor to the coordinates $(X_{41}, Y_{41})$, $\theta_{42}$ is the angle which the straight line which passes through the center $O_2$ of the outer rotor and the coordinates $(X_{41}, Y_{41})$ makes with the X-axis, and $\beta_{40}$ is the correction coefficient for the deformation.

In addition, this outer rotor 20 satisfies the relationships, that are expressed by Equations (17) to (21), with the above-described inner rotor 10.

$$R_a=n\times(R_{a1}\times\gamma_1+R_{a2}\times\gamma_2) \quad (17)$$

$$R_b=(n+1)\times(R_{b1}\times\delta_3+R_{b2}\times\delta_4) \quad (18)$$

$$R_b=R_a+R_{a1}+R_{a2}+H1 \quad (19)$$

$$R_{b2}=R_{a2}+H2 \quad (20)$$

$$e_{10}=R_{a1}+R_{a2}+H3 \quad (21)$$

Here, $e_{10}$ is the distance (eccentricity) between the center $O_1$ of the inner rotor and the center $O_2$ of the outer rotor, and H1, H2, and H3 are correction values for the outer rotor to rotate with clearance.

That is, the shape of the tooth groove $U_{3out}$ is obtained from the shape of the tooth groove $U_{3C}$ by the deformation in the radial direction shown in FIG. 7 (*a*), and the shape of the addendum $U_{4out}$ is obtained from the shape of the addendum $U_{4C}$ by the deformation in the radial direction shown in FIG. 7 (*b*). Thus, by applying the above-mentioned deformation in the circumferential direction and the deformation in the radial direction to the tooth profile U' defined by a cycloid, the tooth profile $U_{out}$ (the shape of the tooth groove $U_{3out}$ and the shape of the addendum $U_{4out}$) of the outer rotor defined by the deformed cycloid can be obtained, thereby the internal tooth profile of the outer rotor 20 shown in FIG. 3 can be formed.

Incidentally, the various conditions and changes mentioned in the descriptions for FIGS. 1 and 2 may also be applicable to the formation of this inner rotor 10 and the outer rotor 20.

[Tooth Profile Defined by Other Mathematical Curves]

Needless to say, the mathematical curve in the present invention is not restricted to a cycloid. As other examples, an envelope of circular arcs centered on a trochoid or a circular-arc-shaped curve in which the addendum portion and the tooth groove portion are defined by two circular arcs that are in contact with each other may be used as the mathematical curve.

And, the tooth profile in accordance with the present invention can be obtained by applying the deformation in the circumferential direction and the deformation in the radial direction, as described above with reference to FIGS. 1 and 2, to the an envelope of circular arcs centered on a trochoid or a circular-arc-shaped curve in which the addendum portion and the tooth groove portion are defined by two circular arcs that are in contact with each other. Here also, the various conditions and changes described with reference to FIGS. 1 and 2 are applicable.

Figure 8:
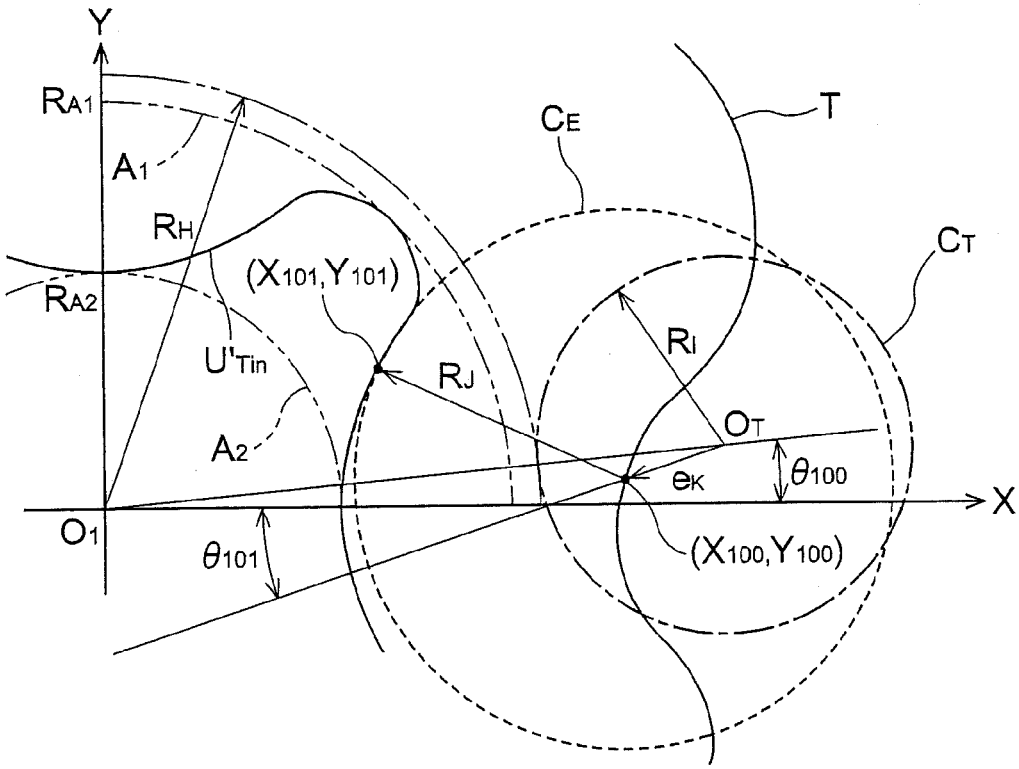
[FIG. 8] is a diagram showing a tooth profile defined by an envelope of circular arcs centered on a trochoid.
Figure 8:
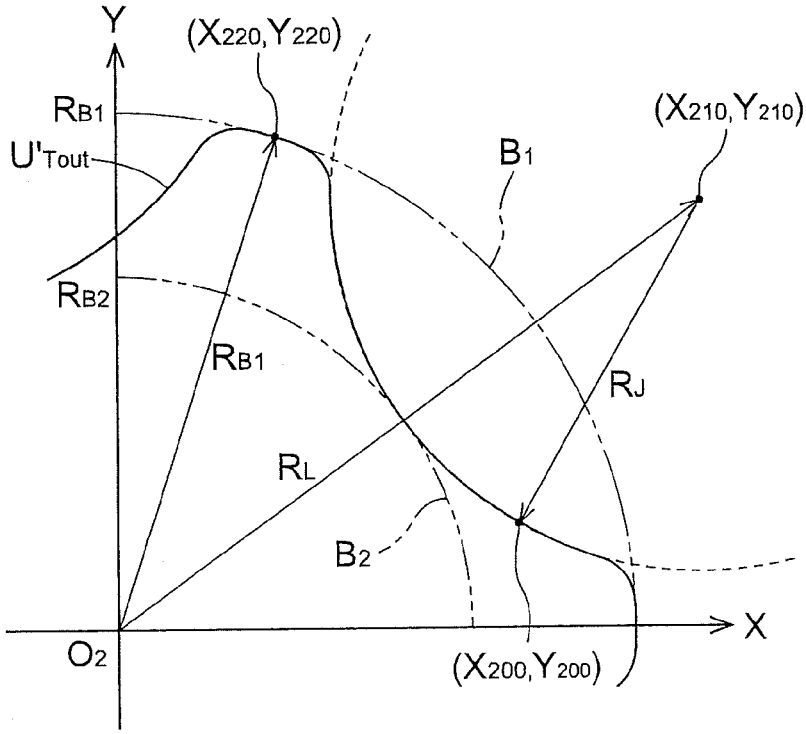
Figure 9:
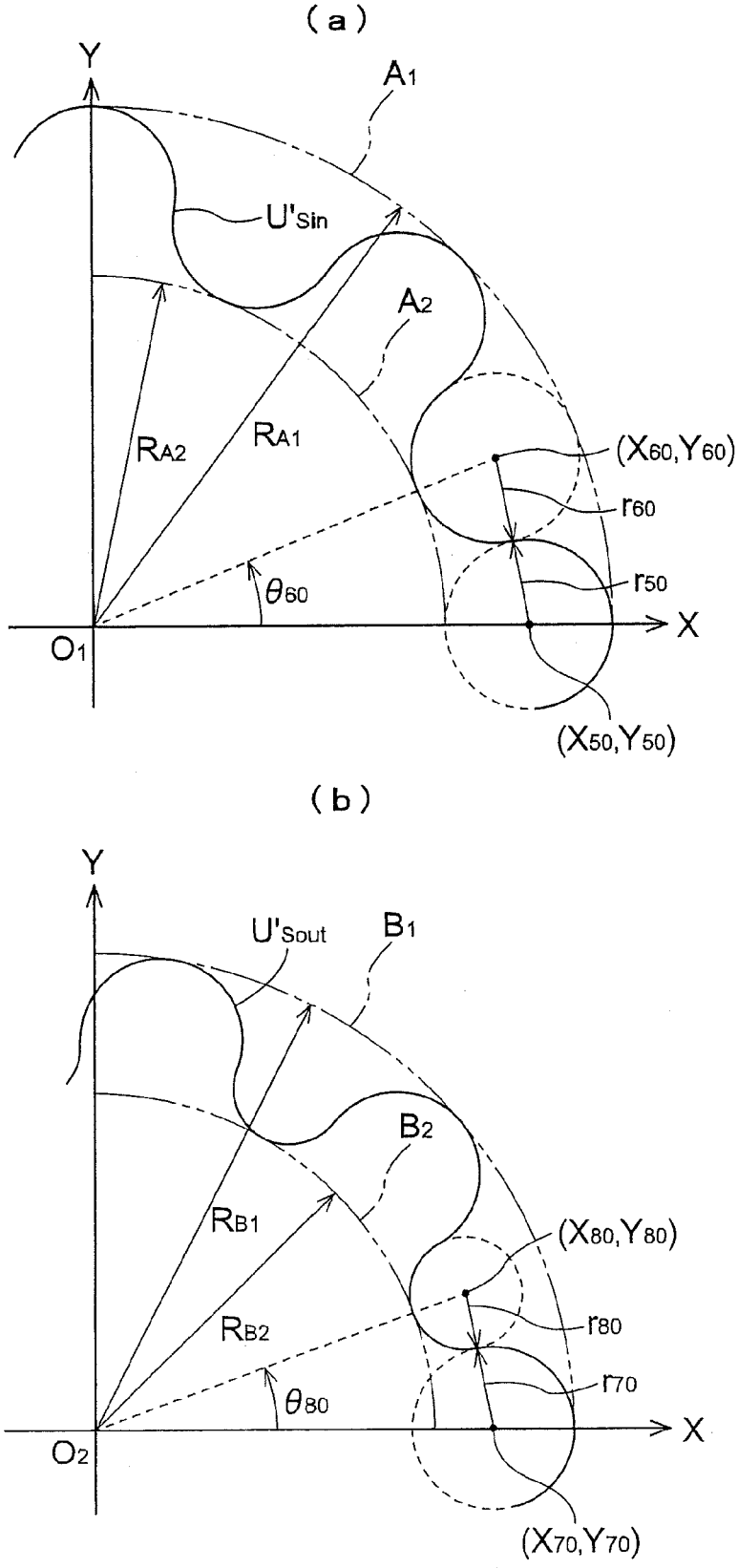
[FIG. 9] is a diagram showing a tooth profile in which the addendum portion and the tooth groove portion are defined by circular arc-shaped curves formed with two circular arcs in contact with each other.

The tooth profile before applying the above-mentioned deformation in the circumferential direction and in the radial direction, i.e., the tooth profile defined by the mathematical curve is shown in FIGS. 8 and 9. The tooth profile (external tooth profile) of the inner rotor defined by the envelope of the circular arcs centered on a trochoid before the deformation is shown in FIG. 8 (*a*), and the tooth profile (internal tooth profile) of the outer rotor which meshes with the inner rotor before the deformation is shown in FIG. 8 (*b*).

In FIG. 8 (*a*), the coordinates of the envelope of the circular arcs centered on a known trochoid which defines the tooth profile $U'_{Tin}$ of the inner rotor before the deformation are expressed by the following Equations (51) to (56). In FIG. 8 (*a*), the radius of the addendum circle $A_1$ and the radius of the tooth groove circle $A_2$ are denoted by $R_{A1}$ and $R_{A2}$, respectively.

$$X_{100}=(R_H+R_I)\times\cos\theta_{100}-e_K\times\cos\theta_{101} \quad (51)$$

$$Y_{100}=(R_H+R_I)\times\sin\theta_{100}-e_K\times\sin\theta_{101} \quad (52)$$

$$\theta_{101}=(n+1)\times\theta_{100} \quad (53)$$

$$R_H=n\times R_I \quad (54)$$

$$X_{101}=X_{100}\pm R_J/\{1+(dX_{100}/dY_{100})^2\}^{1/2} \quad (55)$$

$$Y_{101}=Y_{100}\pm R_J/\{1+(dY_{100}/dX_{100})^2\}^{1/2} \quad (56)$$

Here, the X-axis is a straight line passing through the center $O_1$ of the inner rotor, and the Y-axis is the straight line which intersects perpendicularly with the X-axis and passes through the center $O_1$ of the inner rotor. In Equations (51) to (56), $(X_{100}, Y_{100})$ are the coordinates on the trochoid T, $R_H$ is the radius of the trochoid base circle, $R_I$ is the radius of the trochoid-forming rolling circle, ex is the distance between the center $O_T$ of the trochoid-forming rolling circle and the point of formation of the trochoid T, $\theta_{100}$ is the angle which the straight line that passes through the center of the trochoid-forming rolling circle $O_T$ and the center $O_1$ of the inner rotor makes with the X-axis, $\theta_{101}$ is the angle which the straight line which passes through the center $O_T$ of the trochoid forming rolling circle and the point of formation of the trochoid T makes with the X-axis, $(X_{101}, Y_{101})$ are the coordinates on the envelope, $R_J$ is the radius of circular arcs $C_E$ which form the envelope.

And, the circular-arc-shaped curve which defines the tooth profile $U'_{Tout}$ of the outer rotor before the deformation shown in FIG. 8(*b*) is expressed by the following Equations (57) to (60). In FIG. 8(*b*), the radius of the tooth groove circle $B_1$ and the radius of the addendum circle $B_2$ are denoted by $R_{B1}$ and $R_{B2}$, respectively.

$$(X_{200}-X_{210})^2+(Y_{200}-Y_{210})^2=R_J^2 \quad (57)$$

$$X_{210}^2+Y_{210}^2=R_L^2 \quad (58)$$

$$X_{220}^2+Y_{220}^2=R_{B1}^2 \quad (59)$$

$$R_{B1}=(3\times R_{A1}-R_{A2})/2+g_{10} \quad (60)$$

Here, the X-axis is a straight line passing through the center $O_2$ of the outer rotor, and the Y-axis is the straight line which intersects perpendicularly with the X-axis and passes through the center $O_2$ of the outer rotor. In Equations (57) to (60), $(X_{200}, Y_{200})$ are the coordinates of the circular arc which defines the addendum portion, $(X_{210}, Y_{210})$ are the coordinates of the center of the circle whose circular arc defines the addendum portion, $(X_{220}, Y_{220})$ are the coordinates of the circular arc of the tooth groove circle $B_1$ which defines the tooth groove portion, $R_L$ is the distance between the center $O_2$ of the outer rotor and the center of the circle whose circular arc defines the addendum portion, $R_{B1}$ is the radius of the tooth groove circle $B_1$ which defines the tooth groove portion, $g_{10}$ is the correction value for the outer rotor to rotate with clearance.

Next, the tooth profile (external tooth profile) of the inner rotor whose addendum portion and tooth groove portion are defined by the circular-arc-shaped curve formed of the two circular arcs in contact with each other and before the deformation is shown in FIG. 9 (*a*), and the tooth profile (internal tooth profile) of the outer rotor which meshes with the inner rotor before the deformation is shown in FIG. 9 (*b*).

In FIG. 9 (*a*), the coordinates of the circular-arc-shaped curve expressed by the two circular arcs in contact with each other which define the known addendum portion and tooth groove portion which form the tooth profile $U'_{Sin}$ of the inner rotor before the deformation are expressed by the following Equations (71) to (76).

In FIG. 9 (*a*), the radius of the addendum circle $A_1$ and the radius of the tooth groove circle $A_2$ are denoted by $R_{A1}$ and $R_{A2}$, respectively.

$$(X_{50}-X_{60})^2+(Y_{50}-Y_{60})^2=(r_{50}+r_{60})^2 \quad (71)$$

$$X_{60}=(R_{A2}+r_{60})\times\cos\theta_{60} \quad (72)$$

$$Y_{60}=(R_{A2}+r_{60})\times\sin\theta_{60} \quad (73)$$

$$X_{50}=R_{A1}-r_{50} \quad (74)$$

$$Y_{50}=0 \quad (75)$$

$$\theta_{60}=\pi/n \quad (76)$$

Here the X-axis is a straight line passing through the center $O_1$ of the inner rotor, and the Y-axis is the straight line which intersects perpendicularly with the X-axis and passes through the center $O_1$ of the inner rotor, $(X_{50}, Y_{50})$ are the coordinates of the center of the circular arc which defines the addendum portion, $(X_{60}, Y_{60})$ are the coordinates of the center of the circular arc which defines the tooth groove portion, $r_{50}$ is the radius of the circular arc which defines the addendum portion, $r_{60}$ is the radius of the circular arc which defines the tooth groove portion, $\theta_{60}$ is the angle which the straight line, that passes through the center of the circular arc that defines the addendum portion and the center $O_1$ of the inner rotor, makes with the straight line that passes through the center of the circular arc that defines the tooth groove portion and the center $O_1$ of the inner rotor.

And, the circular-arc-shaped curve which defines the tooth profile $U'_{Sout}$ of the outer rotor before the deformation shown in FIG. 9 (*b*) is expressed by the following Equations (77) to (82). In FIG. 9 (*b*), the radius of the tooth groove circle $B_1$ and the radius of the addendum circle $B_2$ are denoted by $R_{B1}$ and $R_{B2}$, respectively.

$$(X_{70}-X_{80})^2+(Y_{70}-Y_{80})^2=(r_{70}+r_{80})^2 \quad (77)$$

$$X_{80}=(R_{B2}+r_{80})\times\cos\theta_{80} \quad (78)$$

$$Y_{80}=(R_{B2}+r_{80})\times\sin\theta_{80} \quad (79)$$

$$X_{70}=R_{B1}-r_{70} \quad (80)$$

$$Y_{70}=0 \quad (81)$$

$$\theta_{80}=\pi/(n+1) \quad (82)$$

Here the X-axis is a straight line passing through the center $O_2$ of the outer rotor, and the Y-axis is the straight line which intersects perpendicularly with the X-axis and passes through the center $O_2$ of the outer rotor, $(X_{70}, Y_{70})$ are the coordinates of the center of the circular arc which defines the tooth groove portion, $(X_{80}, Y_{80})$ are the coordinates of the center of the circular arc which defines the addendum portion, $r_{70}$ is the radius of the circular arc which defines the tooth groove portion, $r_{80}$ is the radius of the circular arc which defines the addendum portion, $\theta_{80}$ is the angle which the straight line, that passes through the center of the circular arc that defines the addendum portion and the center $O_2$ of the outer rotor, makes with the straight line that passes through the center of the circular arc that defines the tooth groove portion and the center $O_2$ of the outer rotor.

[Tooth Profile to which a Second Deformation in the Radial Direction is Applied]

It is also one of the preferred embodiments of the present invention to apply a further and second deformation in the radial direction to the tooth shape of the addendum portion of the inner rotor obtained in the embodiments described above. The second deformation in the radial direction is described below with reference to FIGS. 10 and 11.

Figure 10:
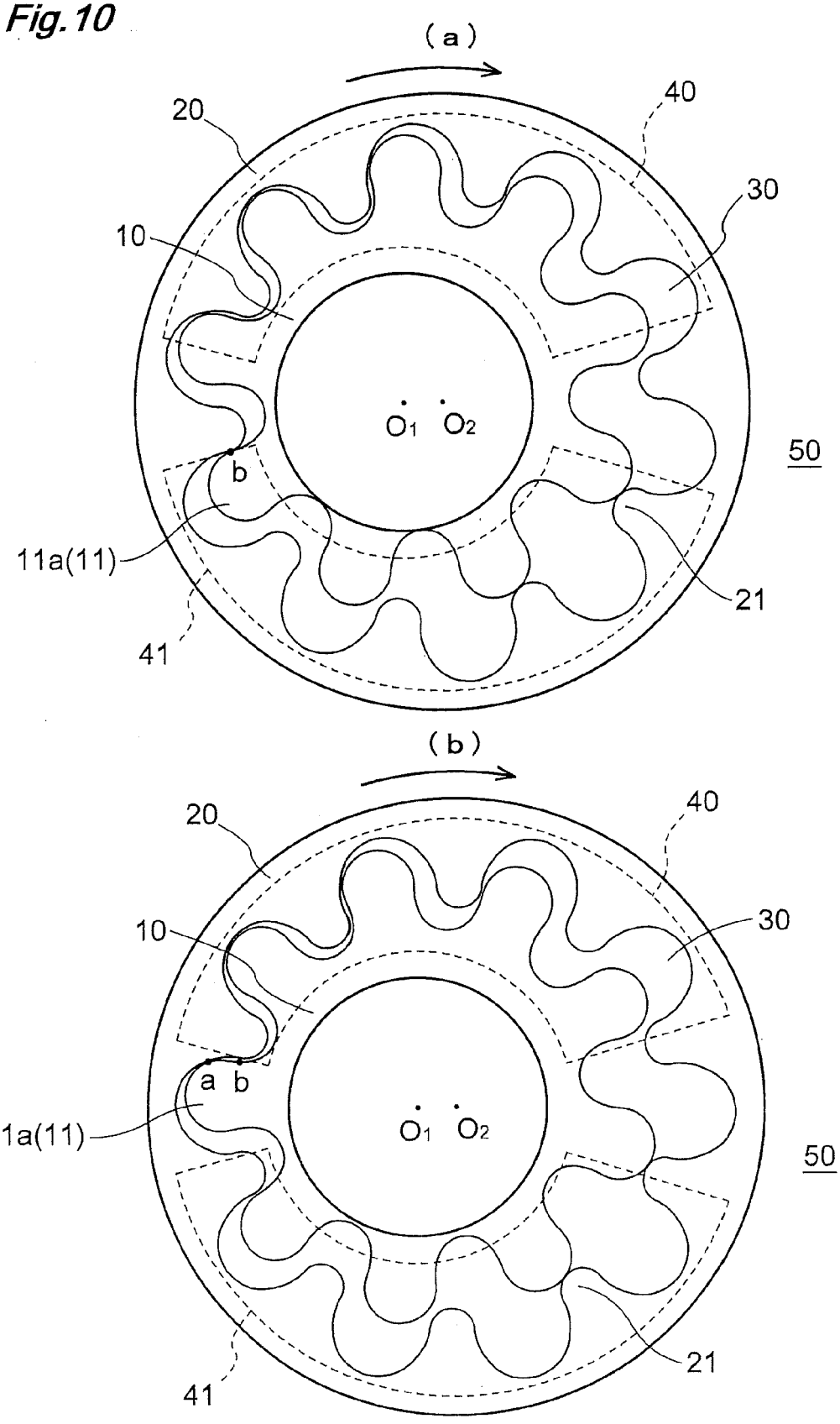
[FIG. 10] is a drawing showing a region of meshing between the inner rotor and the outer rotor.

FIG. 10 is a diagram to describe a method to determine the reference point for performing the second deformation. The oil-pump rotor shown in this drawing is formed by a deformation in the circumferential direction maintaining the distance between the radius $R_{A1}$ of the addendum circle $A_1$ and the radius $R_{A2}$ of the tooth groove circle $A_2$, and a deformation in the radial direction, with both deformation applied to the tooth profile defined by the mathematical curve. The region in which the inner rotor 10 and the outer rotor 20 mesh is obtained based on the tooth profile of these gears. For example, in the example of the oil pump as shown in FIG. 10, the curve which connects the tooth-groove-side meshing point b and the addendum-side meshing point a is the region where the outer rotor 20 meshes with the inner rotor 10. That is, when the inner rotor 10 rotates, the inner rotor 10 and the outer rotor 20 begin to mesh with each other at the tooth-groove-side meshing point b in one of the external teeth 11*a* (FIG. 10 (*a*)). The meshing point gradually slides toward the tip of the external tooth 11*a*, and the inner rotor 10 and the outer rotor 20 disengages or stop meshing finally at the addendum-side meshing point a (FIG. 10 (*b*)).

While FIG. 10 shows the addendum-side meshing point a and the tooth-groove-side meshing point b only for the addendum portion of one the external teeth 11*a* among the external teeth 11 formed in the inner rotor 10, and the meshing points for other teeth are omitted, the same addendum-side meshing point a and the tooth-groove-side meshing point b are defined for all the teeth.

Figure 11:
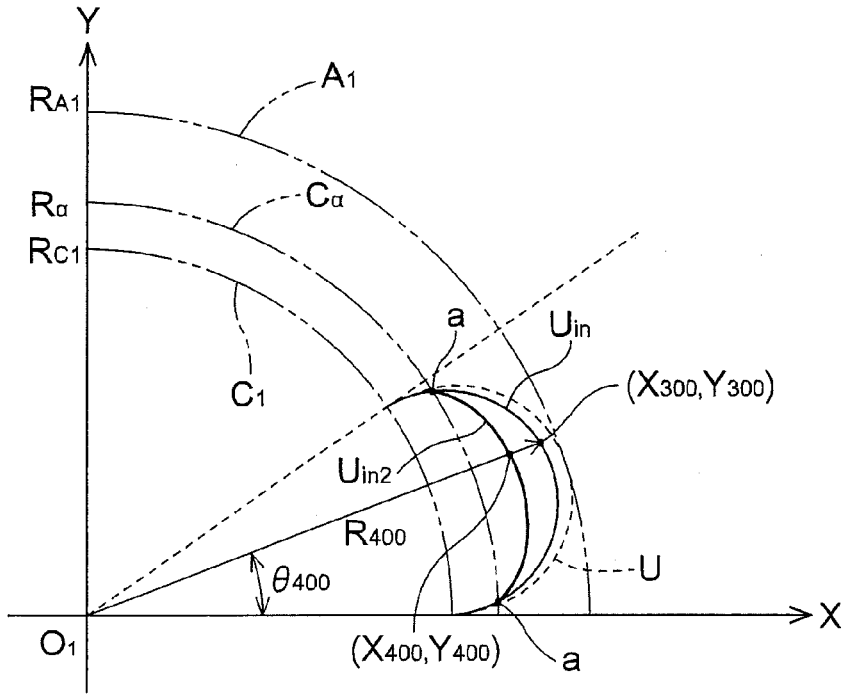
[FIG. 11] is a diagram showing a second deformation of the inner rotor in the radial direction.

FIG. 11 is a diagram for describing the second deformation in the radial direction. The tooth profile U in which the shape of the addendum, of the tooth profile defined by the mathematical curve, is deformed in the circumferential direction is shown in FIG. 11 by the dashed line, and the tooth profile $U_{in}$ which is obtained by further deforming it in the radial direction (hereinafter referred to as the first deformation for convenience) is shown by the solid line. The deformation to obtain the tooth profile U and the tooth profile $U_{in}$ are as described with reference to FIGS. 1 and 2. FIG. 11 also shows a circle $C_\alpha$ of radius $R_\alpha$ which passes through the addendum-side meshing points a of the inner rotor.

In the second deformation in the radial direction, the addendum portion outwardly of the reference circle $C_\alpha$ in the tooth profile $U_{in}$ after the first deformation is deformed with the deformation ratio $\epsilon$ with the circle $C_\alpha$ taken as the reference circle. Here, the deformation ratio $\epsilon$ is a constant which satisfies $0<\epsilon<1$, and the second deformation is always a deformation in a radially inward direction. The deformed tooth profile $U_{in2}$ shown with a heavy solid line in FIG. 11 is obtained by this second deformation in the radial direction. Thus, the tooth profile $U_{in2}$ of the inner rotor thus obtained, and of the addendum portion outwardly of the reference circle $C_\alpha$ which passes the addendum-side meshing points a is the tooth profile defined by the curve defined by Equations (83) to (86).

$$R_{400}=(X_{300}^2+Y_{300}^2)^{1/2} \tag{83}$$

$$\theta_{400}=\arccos(X_{300}/R_{400}) \tag{84}$$

$$X_{400}=\{(R_{400}-R_\alpha)\times\epsilon+R_\alpha\}\times\cos\theta_{400} \tag{85}$$

$$Y_{400}=\{(R_{400}-R_\alpha)\times\epsilon+R_\alpha\}\times\sin\theta_{400} \tag{86}$$

Here, $(X_{300}, Y_{300})$ are the coordinates of the shape of the addendum $U_{in}$ after the first deformation in the radial direction, $(X_{400}, Y_{400})$ are the coordinates of the shape of the addendum $U_{in2}$ after the second deformation in the radial direction, $R_{400}$ is the distance from the center $O_1$ of the inner rotor to the coordinates $(X_{300}, Y_{300})$, and $\theta_{400}$ is the angle which the straight line which passes through the center $O_1$ of the inner rotor and the coordinates $(X_{300}, Y_{300})$ makes with the X-axis.

In addition, while only the addendum portion of one tooth among the external teeth formed in the inner rotor is shown and other teeth are omitted in FIG. 11, the same deformation is naturally performed to all the teeth.

Figure 12:
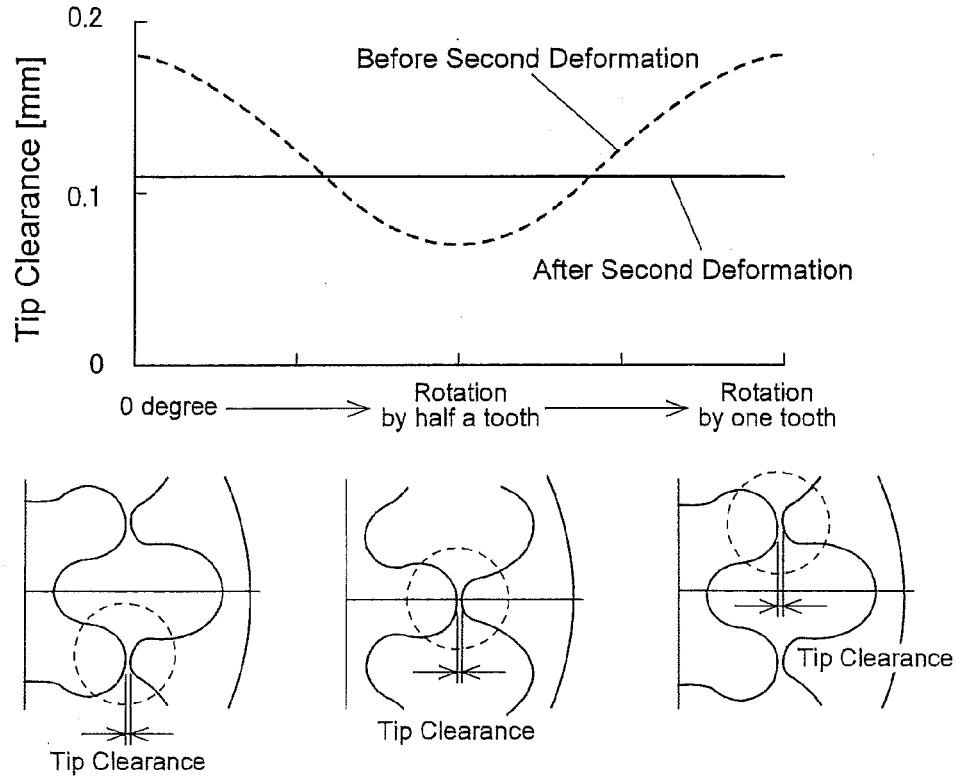
[FIG. 12] shows a graph showing the relationship between the rotation angle of the inner rotor and the tip clearance.

FIG. 12 is a graph showing changes in the tip clearance with the rotation of the inner rotor. In this example, the data shown is for the case where after deforming a cycloid in the circumferential direction and in the radial direction, further deformation is applied to the addendum portion outwardly of the reference circle $C_\alpha$ which passes through the addendum-side meshing point a of the inner rotor with the deformation ratio $\epsilon=0.5$ as one example. In addition, in this graph, the degree of rotation angle of the inner rotor is taken with respect to the position where both the tooth groove portion of the inner rotor and the tooth groove portion of the outer rotor are located on the straight line which connects the axis $O_1$ of the inner rotor and the axis $O_2$ of the outer rotor which are offset from each other.

According to this, for the tooth profile before the second deformation in the radial direction, the tip clearance varies like a trigonometric function with the rotation of the inner rotor so that the tip clearance attains its maximum when the rotation angle of the inner rotor is at 0 degree, and attains its minimum when it rotates through half a tooth. On the other hand, for the tooth profile after the second deformation, the tip clearance is constant regardless of the rotation angle of the inner rotor. Therefore, for the one to which the second deformation in the radial direction is applied, since the amount of oil leakage between the addendum portions of the inner rotor 10 and the outer rotor 20 is stabilized, it becomes possible to further suppress the pulsation of the oil discharged from the oil pump.

[Compressing Deformation in the Circumferential Direction]

While the external tooth profile of the inner rotor is formed in each of the above-mentioned configurations by the deformation in the circumferential direction and in the radial direction applied to the tooth profile defined by a mathematical curve, the external tooth profile of the inner rotor may be formed by a compressing deformation in the circumferential direction, omitting the deformation in the radial direction. As mentioned above, by applying a deformation in the circumferential direction and a deformation in the radial direction, the amount of discharge can be increased without increasing the size of the rotor (i.e. preventing the size increase of the rotor), and the number of teeth may be increased to provide an oil-pump rotor with reduced pulsation and noise level. However, by applying only a compressing deformation in the circumferential direction, the amount of discharge can be increased while maintaining the radius of the rotor and the number of teeth may be increased to provide an oil pump rotor with reduced pulsation and noise level.

Here, the shape of the addendum and the shape of the tooth groove may be deformed with the same deformation ratio ($\gamma_1=\gamma_2$ in FIG. 1). Needless to say, the same deformation may be applied to the outer rotor.

[Different Embodiment for the Tooth Profile of the Outer Rotor]

With respect to the outer rotor that meshes properly with the inner rotor having an external tooth profile obtained by applying various deformation to the tooth profile defined by a mathematical curve, such as ones described in the embodiment mentioned above, namely, the deformation in the circumferential direction maintaining the distance between the radius $R_{A1}$ of the addendum circle $A_1$ and the radius $R_{A2}$ of the tooth groove circle $A_2$ and the deformation in the radial direction, or the above-mentioned compressing deformation in the circumferential direction, the outer rotor may be formed as described in the following different embodiment although the same deformation as the one(s) applied to the inner rotor may be applied to the outer rotor. The following deformation may be applied to any inner rotor. And this different embodiment is described in detail with reference to FIG. 13.

Figure 13:
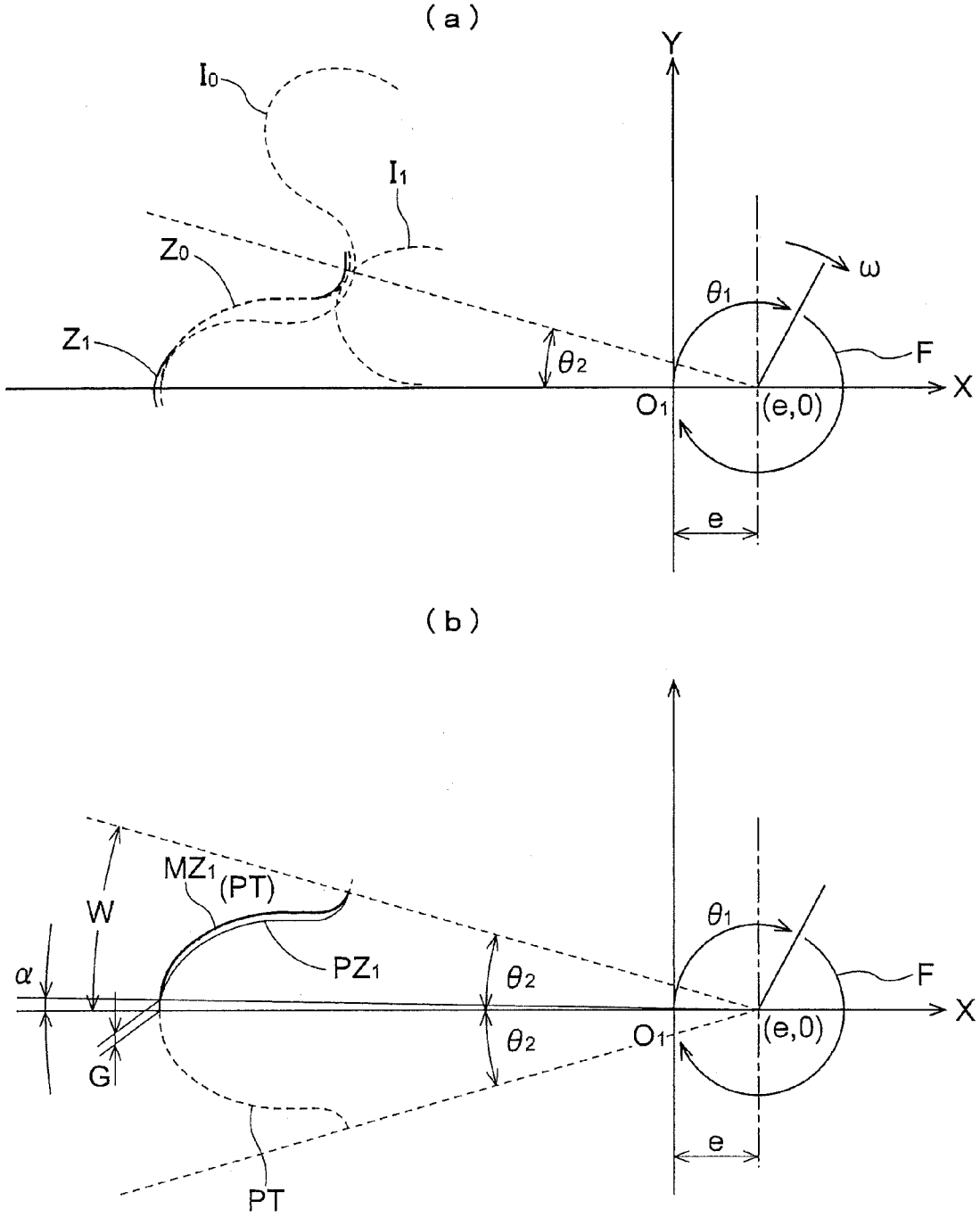
[FIG. 13] is a diagram to describe forming of the outer rotor.

Firstly, as shown in FIG. 13(*a*), the X-axis is the straight line passing through the center $O_1$ of the inner rotor 10, the Y-axis is the straight line which intersects perpendicularly with the X-axis and passes through the center $O_1$ of the inner rotor 10, and the origin is the center $O_1$ of the inner rotor 10. In addition, we let the coordinates (e, 0) be a position a predetermined distance e away from the center $O_1$ of the inner rotor 10, and let the circle of the radius e centered on these coordinates (e, 0) be a circle F.

First, the envelope $Z_0$ shown in FIG. 13 (*a*) can be formed by making the center $O_1$ of the inner rotor 10 revolve along the circumference of this circle F clockwise at an angular velocity $\omega$ while rotating the center $O_1$ about itself anti-clockwise at an angular velocity $\omega/n$ (n is the number of teeth of the inner rotor). In FIG. 13, the revolution angle is taken as the angle of the center $O_1$ of the inner rotor 10 as seen from the center (e, 0) of the circle F at the start of the revolution, i.e., the revolution angle is such that the negative direction of the X-axis is taken to be 0 revolution angle and its value increases with a clockwise rotation.

The following operation is performed to obtain a curve in which the envelope $Z_0$ is deformed by deforming, in the radially outward direction, at least a neighborhood of an intersecting portion between the envelope $Z_0$ and the axis in the direction of 0 revolution angle, and by deforming, in the radially outward direction, a neighborhood of an intersecting portion between the envelope $Z_0$ and the axis in the direction of the revolution angle $\theta_2(=\pi/(n+1))$ to an extent less than or equal to the radially outward deformation of the neighborhood of the intersecting portion between the envelope $Z_0$ and the axis in the direction of 0 revolution angle.

When making the center $O_1$ of the inner rotor 10 revolve along the circumference of the circle F while making it rotate about itself as mentioned above, the shape of the addendum of the inner rotor 10 is deformed in the radially outward direction with an expanding correction coefficient $\beta_1$ when the revolution angle is greater or equal to 0 and less than or equal to $\theta_1$, and the shape of the addendum of the inner rotor 10 is deformed in the radially outward direction with an expanding correction coefficient $\beta_2$ when the revolution angle is greater or equal to $\theta_1$ and less than $2\pi$. However, while, in the present embodiment, the value of the extended correction coefficient $\beta_2$ is smaller than the value of the extended correction coefficient $\beta_1$, the value of the extended correction coefficient $\beta_2$ and the value of the extended correction coefficient $\beta_1$ may be chosen at will, without being limited to this relationship.

As shown in FIG. 13 (*a*), with this operation, since the inner rotor is deformed in the radially outward direction with the extended correction coefficient $\beta_1$ when the inner rotor 10 is in the position shown at the dotted line $I_0$, and it is deformed in the radially outward direction to a lesser extent with the extended correction coefficient $\beta_2$ compared with the case of $\beta_1$ when it is in the position shown at the dotted line $I_1$, the resulting envelope $Z_1$ has the shape such that its neighborhood of the intersecting portion with the axis in the direction of 0 revolution angle is deformed in the radially outward direction compared with the envelope $Z_0$, and the neighborhood of the intersecting portion with the axis in the direction of revolution angle $\theta_2$ is deformed in the radially outward direction to a lesser extent compared with the radially outward deformation of the neighborhood of the intersecting portion with the axis in the direction of 0 revolution angle. When the value of the extended correction coefficient $\beta_2$ is equal to the value $\beta_1$, the two portions are deformed equally in the radially outward direction.

Next, as shown in FIG. 13 (*b*), the portion contained in the region W defined by the revolution angle greater than or equal to 0 and less than or equal to $\theta_2$ in the envelope $Z_1$ (i.e. region between the axis in the direction of 0 revolution angle and the axis in the direction of the revolution angle $\theta_2$) is extracted as a partial envelope $PZ_1$.

And the extracted partial envelope $PZ_1$ is rotated in the revolution direction with respect to the center (e, 0) of the circle F by a minute angle $\alpha$, and the portion that falls out of the region W by rotation is cut off, and the gap G formed between the partial envelope $PZ_1$ and the axis in the direction of 0 revolution angle is connected to form a corrected partial envelope $MZ_1$. While the gap G is connected with a straight line in this embodiment, the connection may be made not only with the straight line but with a curve.

Further, this corrected partial envelope $MZ_1$ is duplicated to have a line symmetry with respect to the axis in the direction of 0 revolution angle to form a partial tooth profile PT, and the tooth profile of the outer rotor 20 is formed by duplicating this partial tooth profile PT at every rotation angle of $2\pi/(n+1)$ with respect to the center (e, 0) of the circle F.

By forming the outer rotor using the envelope $Z_1$ defined as described above by deforming the envelope $Z_0$, a proper clearance between the inner rotor 10 and the outer rotor 20 is reliably obtained. And, a proper backlash can be obtained by rotating the partial envelope $PZ_1$ by a minute angle $\alpha$. Thus, an outer rotor 20 which meshes and rotates smoothly with the deformed inner rotor 10 can be obtained.

[Other Embodiments]

Although a deformation in the circumferential direction and a deformation in the radial direction, or a compressing deformation in the circumferential direction is applied to the tooth profile defined by a mathematical curve in each of the embodiments mentioned above to form the external tooth profile (internal tooth profile) of the inner rotor 10 (outer rotor 20) in the oil pump rotor, a deformation only in the radial direction may be applied to form the external tooth profile (internal tooth profile) of the inner rotor 10 (outer rotor 20). Also, the deformation in the radial direction is not restricted to the deformation to both of the addendum and the tooth groove, but can be applied to form either one of the addendum and the tooth groove.

Industrial Applicability

The present invention may be used in an oil pump rotor which draws in and discharges fluid through volume changes in cells formed between the inner rotor and the outer rotor.

The invention claimed is:

1. An oil pump rotor comprising:

an inner rotor formed with n (n: a natural number) external teeth, and an outer rotor formed with n+1 internal teeth which are in meshing engagement with each of the external teeth, wherein the oil pump rotor is used in an oil pump which includes a casing having a suction port for drawing in fluid and a discharge port for discharging fluid and which conveys the fluid by drawing in and discharging the fluid due to changes in volumes of cells formed between surfaces of the internal teeth and surfaces of the external teeth during rotations of the rotors under meshing engagement therebetween, and wherein a tooth profile of the external teeth of the inner rotor is formed by a deformation in a circumferential direction and by a deformation in a radial direction applied to a tooth profile defined by a mathematical curve, with the deformation in a circumferential direction being applied while maintaining a radius $R_{A1}$ of an addendum circle $A_1$ and a radius $R_{A2}$ of a tooth groove circle $A_2$, said deformation in the circumferential direction resulting in increase in a number of said external teeth relative to a number of said external teeth before said deformation.

2. An oil pump rotor as defined in claim 1, wherein the mathematical curve is one of an envelope of circular arcs centered on a cycloid or a trochoid, and a circular-arc-shaped curve in which the addendum portion and the tooth groove portion are defined by two circular arcs that are in contact with each other.

3. An oil pump rotor as defined in claim 1, wherein the deformation in the circumferential direction is applied with a first deformation ratio $\gamma_1$ when a portion outwardly of the circle $C_1$ of radius $R_{C1}$ which satisfies $R_{A1}>R_{C1}>R_{A2}$ is deformed, and is applied with a second deformation ratio $\gamma_2$ when a portion inwardly of the circle $C_1$ is deformed, and in a deformation in the radial direction, when a portion outwardly of the circle $D_1$ of radius $R_{D1}$ which satisfies $R_{A1}>R_{D1}\geqq R_{C1}\geqq R_{D2}>R_{A2}$ is deformed, a shape of an addendum is defined by a curve formed by Equations (1) to (4), and when a portion inwardly of the circle $D_2$ of radius $R_{D2}$ is deformed, a shape of a tooth groove is defined by a curve defined by Equations (5) to (8) wherein $$R_{12}=(X_{11}^2+Y_{11}^2)^{1/2}, \quad (1)$$

$$\theta_{12}=\arccos(X_{11}/R_{12}), \quad (2)$$

$$X_{12}=\{(R_{12}-R_{D1})\times\beta_{10}+R_{D1}\}\times\cos\theta_{12}, \quad (3)$$

$$Y_{12}=\{(R_{12}-R_{D1})\times\beta_{10}+R_{D1}\}\times\sin\theta_{12}, \quad (4)$$

where, $(X_{11}, Y_{11})$ are coordinates of the shape of the addendum before the deformation in the radial direction, $(X_{12}, Y_{12})$ are coordinates of the shape of the addendum after the deformation in the radial direction, $R_{12}$ is a distance from the center of the inner rotor to the coordinates $(X_{11}, Y_{11})$, $\theta_{12}$ is an angle which the straight line which passes through the center of the inner rotor and the coordinates $(X_{11}, Y_{11})$ makes with an X-axis, and $\beta_{10}$ is a correction coefficient for the deformation and wherein $$R_{22}=(X_{21}^2+Y_{21}^2)^{1/2}, \quad (5)$$

$$\theta_{22}=\arccos(X_{21}/R_{22}), \quad (6)$$

$$X_{22}=\{R_{D2}-(R_{D2}-R_{22})\times\beta_{20}\}\times\cos\theta_{22}, \quad (7)$$

$$Y_{22}=\{R_{D2}-(R_{D2}-R_{22})\times\beta_{20}\}\times\sin\theta_{22}, \quad (8)$$

where, $(X_{21}, Y_{21})$ are coordinates of the shape of the tooth groove before the deformation in the radial direction, $(X_{22}, Y_{22})$ are coordinates of the shape of the tooth groove after the deformation in the radial direction, $R_{22}$ is a distance from the center of the inner rotor to the coordinates $(X_{21}, Y_{21})$, $\theta_{22}$ is an angle which a straight line which passes through the center of the inner rotor and the coordinates $(X_{21}, Y_{21})$ makes with the X-axis, and $\beta_{20}$ is a correction coefficient for the deformation.

4. An oil pump rotor as defined in claim 1, wherein an addendum portion, outwardly of a reference circle $C_\alpha$ that goes through an addendum side meshing point a of the inner rotor with the outer rotor, is deformed with a deformation ratio $\epsilon$ that satisfies $0<\epsilon<1$.

5. An oil pump rotor as defined in claim 3, wherein a profile of the external teeth of the inner rotor is formed by a deformation, in the circumferential direction and a deformation in the radial direction with a base circle of a cycloid being the circle $C_1$, applied to a tooth profile defined by the cycloid with a base circle radius $R_a$, exterior rolling circle radius $R_{a1}$, and an interior rolling circle radius $R_{a2}$, a profile of the internal teeth of the outer rotor that meshes with the inner rotor is formed by a deformation in the circumferential direction and a deformation in the radial direction applied to a tooth profile defined by a cycloid with a base circle radius $R_b$, exterior rolling circle radius $R_{b1}$, and an internal rolling circle radius $R_{b2}$ with the deformation in the circumferential direction applied while maintaining a distance between a radius $R_{B1}$ of an tooth groove circle $B_1$ and the radius $R_{B2}$ of an addendum circle $B_2$, wherein the deformation in the circumferential direction is applied with a third deformation ratio $\delta_3$ when a portion outwardly of the base circle of radius $R_b$ is deformed, and is applied with a fourth deformation ratio $\delta_4$ when a portion inwardly of the base circle of radius $R_b$ is deformed, and, in the deformation of the outer rotor in the radial direction, a shape of a tooth groove is defined by a curve defined by Equations (9) to (12) when a portion outwardly of the circle $D_3$ of radius $R_{D3}$ which satisfies $R_{B1}>R_{D3}\geqq R_b\geqq R_{D4}>R_{B2}$ is deformed, and a shape of an addendum is defined by a curve defined by Equations (13) to (16) when a portion inwardly of a circle $D_4$ of radius $R_{D4}$ is deformed, and the outer rotor satisfies relationships that are expressed by Equations (17) to (21), with the inner rotor wherein $$R_{32}=(X_{31}^2+Y_{31}^2)^{1/2}, \quad (9)$$

$$\theta_{32}=\arccos(X_{31}/R_{32}), \quad (10)$$

$$X_{32}=\{(R_{32}-R_{D3})\times\beta_{30}+R_{D3}\}\times\cos\theta_{32}, \quad (11)$$

$$Y_{32}=\{(R_{32}-R_{D3})\times\beta_{30}+R_{D3}\}\times\sin\theta_{32}, \quad (12)$$

where $(X_{31}, Y_{31})$ are coordinates of the shape of the tooth groove before the deformation in the radial direction, $(X_{32},$ $Y_{32}$) are coordinates of the shape of the tooth groove after the deformation in the radial direction, $R_{32}$ is a distance from the center of the outer rotor to the coordinates ($X_{31}$, $Y_{31}$), $\theta_{32}$ is an angle which a straight line which passes through the center of the outer rotor and the coordinates ($X_{31}$, $Y_{31}$) makes with the X-axis, and $\beta_{30}$ is a correction coefficient for the deformation, wherein $$R_{42}=(X_{412}+Y_{412})^{1/2}, \quad (13)$$

$$\theta_{42}=\arccos(X_{41}/R_{42}), \quad (14)$$

$$X_{42}=\{R_{D4}-(R_{D4}-R_{42})\times\beta_{40}\}\times\cos\theta_{42}, \quad (15)$$

$$Y_{42}=\{R_{D4}-(R_{D4}-R_{42})\times\beta_{40}\}\times\sin\theta_{42}, \quad (16)$$

where, ($X_{41}$, $Y_{41}$) are coordinates of the shape of an addendum before the deformation in the radial direction, ($X_{42}$, $Y_{42}$) are coordinates of the shape of an addendum after the deformation in the radial direction, $R_{42}$ is a distance from the center of the outer rotor to the coordinates ($X_{41}$, $Y_{41}$), $\theta_{42}$ is an angle which the straight line which passes through the center of the outer rotor and the coordinates ($X_{41}$, $Y_{41}$) makes with the X-axis, and $\beta_{40}$ is a correction coefficient for the deformation, and $$R_a=n\times(R_{a1}\times\gamma_1+R_{a2}\times\gamma_2), \quad (17)$$

$$R_b=(n+1)\times(R_{b1}\times\delta_3+R_{b2}\times\delta_4), \quad (18)$$

$$R_b=R_a+R_{a1}+R_{a2}+H1, \quad (19)$$

$$R_{b2}=R_{a2}+H2, \quad (20)$$

$$e_{10}=R_{a1}+R_{a2}+H3, \quad (21)$$

where, $e_{10}$ is a distance or eccentricity between the center of the inner rotor and the center of the outer rotor, and H1, H2, and H3 are correction values for the outer rotor to rotate with clearance.

6. An oil pump rotor comprising:

an inner rotor formed with n (n: a natural number) external teeth, and an outer rotor formed with n+1 internal teeth which are in meshing engagement with each of the external teeth, wherein the oil pump rotor is used in an oil pump which includes a casing having a suction port for drawing in fluid and a discharge port for discharging fluid and which conveys the fluid by drawing in and discharging the fluid due to changes in volumes of cells formed between surfaces of the internal teeth and surfaces of the external teeth during rotations of the rotors under meshing engagement therebetween, and wherein a tooth profile of the external teeth of the inner rotor is formed by a compressing deformation in a circumferential direction applied to a tooth profile defined by a mathematical curve while maintaining a distance between a radius $R_{A1}$ of an addendum circle $A_1$ and a radius $R_{A2}$ of a tooth groove circle $A_2$, said deformation in the circumferential direction resulting in increase in a number of said external teeth relative to a number of said external teeth before said deformation.

7. An oil pump rotor as defined in claim 1, wherein the outer rotor that meshes with the inner rotor has a tooth profile formed by:

with an envelope formed by making the inner rotor revolve along a circumference of a circle F centered on a position that is a set distance e away from the center of the inner rotor and having a radius equal to the set distance at an angular velocity ω, while rotating the inner rotor about itself in a direction opposite to a direction of the revolution at an angular velocity ω/n which is 1/n times the angular velocity ω of the revolution with a revolution angle being defined such that an angle of the center of the inner rotor as seen from the center of the circle F is taken to be 0 revolution angle at a start of the revolution, deforming, in a radially outward direction, at least a neighborhood of an intersecting portion between the envelope and an axis in a direction of 0 revolution angle;

deforming, in a radially outward direction, a neighborhood of an intersecting portion between the envelope and an axis in a direction of the revolution angle π/(n+1);

extracting, as a partial envelope, a portion contained in a region defined by revolution angles greater than or equal to 0 and less than or equal to π/(n+1) in the envelope;

rotating the partial envelope in a direction of revolution with respect to the center of the circle by a minute angle α;

cutting off a portion that falls out of the region;

connecting a gap formed between the partial envelope and the axis in the direction of 0 revolution angle to form a corrected partial envelope;

duplicating the corrected partial envelope to have a line symmetry with respect to the axis in the direction of 0 revolution angle to form a partial tooth profile; and duplicating the partial tooth profile at every rotation angle of 2π/(n+1) with respect to the center of the circle F.

* * * * *